US011472221B2

(12) United States Patent
Nakajima et al.

(10) Patent No.: US 11,472,221 B2
(45) Date of Patent: Oct. 18, 2022

(54) WRITING IMPLEMENT

(71) Applicant: MITSUBISHI PENCIL COMPANY, LIMITED, Tokyo (JP)

(72) Inventors: Tooru Nakajima, Yokohama (JP); Takeo Fukumoto, Yokohama (JP); Gouya Oono, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 497 days.

(21) Appl. No.: 16/606,316

(22) PCT Filed: Apr. 17, 2018

(86) PCT No.: PCT/JP2018/015915
§ 371 (c)(1),
(2) Date: Oct. 18, 2019

(87) PCT Pub. No.: WO2018/194071
PCT Pub. Date: Oct. 25, 2018

(65) Prior Publication Data

US 2022/0194120 A1 Jun. 23, 2022

(30) Foreign Application Priority Data

Apr. 21, 2017 (JP) ..... JP2017-084741

(51) Int. Cl.
*B43K 8/06* (2006.01)
*B43K 1/12* (2006.01)
*B43K 3/04* (2006.01)

(52) U.S. Cl.
CPC ..... *B43K 8/06* (2013.01); *B43K 1/12* (2013.01); *B43K 3/04* (2013.01)

(58) Field of Classification Search
CPC ... B43K 8/06; B43K 1/12; B43K 3/04; B43K 3/00; B43K 3/02; B43K 5/16; B43K 7/12; B43K 8/24
(Continued)

(56) References Cited

U.S. PATENT DOCUMENTS 4,708,508 A 11/1987 Nagahama et al.
5,192,154 A * 3/1993 Moeck ..... B43K 8/026 401/207
(Continued)

FOREIGN PATENT DOCUMENTS

JP 57189883 U 12/1982
JP S59104784 U 7/1984
(Continued)

OTHER PUBLICATIONS

International Search Report and Written Opinion for Application No. PCT/JP2018/015915, dated Oct. 25, 2018, 9 Pages (including English Translation of ISR).
(Continued)

*Primary Examiner* — David J Walczak
(74) *Attorney, Agent, or Firm* — Brooks Kushman P.C.

(57) ABSTRACT

An object is to provide a writing implement allowing the width of a drawn line to be freely changed by writing pressure that is capable of application to a narrow-shafted felt-tip pen or marker pen. The writing implement includes a shall tube, an ink supply core that is housed inside the shaft tube and that guides ink by capillary action, and a core surrounding member that is fitted to a leading end of the shaft tube, that is penetrated by the ink supply core, and from which a tip of the ink supply core projects. The ink supply core is configured to retract at a tip of the core surrounding member under writing pressure, and a projection dimension
(Continued)

of the ink supply core from the tip of the core surrounding member is from 0.05 mm to 0.7 mm.

11 Claims, 31 Drawing Sheets

(58) Field of Classification Search
USPC ..... 401/54, 103
See application file for complete search history.

(56) References Cited

U.S. PATENT DOCUMENTS 5,415,487 A * 5/1995 Rukan ..... B43K 7/02 401/109
6,641,320 B1 * 11/2003 Ballot ..... B43K 5/1845 401/206
7,959,368 B2 * 6/2011 Sheu ..... B43K 23/128 401/103
2011/0013966 A1 1/2011 Ballot
2012/0141189 A1 6/2012 Sawa et al.
2017/0144472 A1 5/2017 Nakajima et al.

FOREIGN PATENT DOCUMENTS

JP S61132392 A 6/1986
JP 885291 A 4/1996
JP 2005131943 A 5/2005
JP 2011072988 A 4/2011
JP 2016026930 A 2/2016

OTHER PUBLICATIONS

Office Action of Japanese patent application No. 2018-078975 dated Jan. 4, 2022, 6 pages.

* cited by examiner

WRITING IMPLEMENT

CROSS-REFERENCE TO RELATED APPLICATIONS

This application is the U.S. national phase of PCT Application No. PCT/JP2018/015915 filed on Apr. 17, 2018, which claims priority to Japanese Patent Application No. 2017-084741 filed on Apr. 21, 2017, which are incorporated herein by reference in their entireties.

TECHNICAL FIELD

The present invention relates to a writing implement.

BACKGROUND ART

Japanese Patent Application Laid-Open (JP-A) No. 2016-026930 discloses a writing implement including a shaft tube, an ink supply core that is housed inside the shaft tube and that is capable of guiding ink by capillary action, and a core surrounding member that covers an outer periphery of the ink supply core. The ink supply core and the core surrounding member are partially exposed from a leading end of the shaft tube. The writing implement includes a displacement means that is capable of changing a relative positional relationship between the ink supply core and the core surrounding member in an axial direction. The displacement means causes the ink supply core to retract relative to the core surrounding member so as to enable the tip of the ink supply core and the tip of the core surrounding member to contact a writing surface at the same time.

In writing implements in which a core surrounding member penetrated by an ink supply core is housed inside a shaft tube in this manner, a phenomenon in which ink guided to the tip by the capillary action of the ink supply core runs between the ink supply core and the core surrounding member and rises into the shaft tube interior is often observed. For example, in cases in which the shaft tube is formed using a material that allows the interior of the shaft tube to be seen, ink that can be seen rising as far as the shaft tube interior is detrimental to the appearance. Not only that, but there is also a possibility of dried ink blocking ventilation holes placing the interior and the exterior of the shaft tube in communication with each other, thus obstructing the interchange of ink and air and preventing ink from being discharged, this being detrimental the writing function.

SUMMARY OF INVENTION

Technical Problem

An object of an aspect of the present disclosure is to provide a writing implement allowing the width of a drawn line to be freely changed by writing pressure that is capable of application to a narrow-shafted felt-tip pen or marker pen.

In addition to the above object, an object of another aspect of the present disclosure is to prevent the phenomenon in which ink that has leaked out at the tip of an ink supply core that guides ink by capillary action runs between the ink supply core and a core surrounding member and rises as far as the interior of a shaft tube.

Solution to Problem

A writing implement according to a first aspect of the present disclosure includes a shaft tube, an ink supply core that is housed inside the shaft tube and that guides ink by capillary action, and a core surrounding member that is fitted to a leading end of the shaft tube, that is penetrated by the ink supply core, and from which a tip of the ink supply core projects. The ink supply core is configured to retract at a tip of the core surrounding member under writing pressure, and a projection dimension of the ink supply core from the tip of the core surrounding member is from 0.05 mm to 0.7 mm when not being used to write.

A writing implement according to a second aspect of the present disclosure is the writing implement according to the first aspect, wherein the ink supply core includes a flow path configured to guide ink internally by capillary action, the core surrounding member includes a tip opening from which the tip of the ink supply core projects, and a value obtained by subtracting an external diameter of the flow path from an internal diameter of the tip opening is 0.5 mm or less.

Note that this value may be a negative number.

A writing implement according to a third aspect of the present disclosure is the writing implement according to the second aspect, wherein the value obtained by subtracting the external diameter of the flow path from the internal diameter of the tip opening is less than zero.

A writing implement according to a fourth aspect of the present disclosure is the writing implement of any one of the first aspect to the third aspect, wherein the core surrounding member includes a tip portion, a rear end portion, and an elastic portion between the tip portion and the rear end portion. The elastic portion enables the ink supply core to retract together with the rear end portion.

A writing implement according to a fifth aspect of the present disclosure is the writing implement according to the fourth aspect, wherein the elastic portion is integral to the tip portion.

A writing implement according to a sixth aspect of the present disclosure is the writing implement according to the fourth aspect, wherein the elastic portion is a separate body from the tip portion.

A writing implement according to a seventh aspect of the present disclosure is the writing implement of any one of the fourth aspect to the sixth aspect, wherein the elastic portion elongates rearward under writing pressure.

A writing implement according to an eighth aspect of the present disclosure is the writing implement of any one of the fourth aspect to the seventh aspect, wherein the ink supply core and the core surrounding member are fixed to each other.

A writing implement according to a ninth aspect of the present disclosure is the writing implement according to the eighth aspect, wherein the fixing is performed by impact deformation of an outer peripheral face of a rear end portion of the core surrounding member.

In a writing implement according to a tenth aspect of the present disclosure, an expanded location is provided at a tip portion of the ink supply core such that a gap between the ink supply core and the core surrounding member is expanded around an entire periphery of the tip portion.

A writing implement according to an eleventh aspect of the present disclosure is the writing implement according to the tenth aspect, wherein the expanded location is provided by providing a step portion that locally reduces an external diameter around the entire periphery of the tip portion of the ink supply core.

A writing implement according to a twelfth aspect of the present disclosure is the writing implement according to the tenth aspect, wherein the expanded location is provided by providing a ring-shaped groove around the entire periphery of the tip portion of the ink supply core.

A writing implement according to a thirteenth aspect of the present disclosure is the writing implement of any one of the tenth aspect to the eleventh aspect, wherein for a given writing load, a value obtained by dividing a width of a line drawn at a writing angle of 60° with respect to a writing surface by a width of a line drawn at a writing angle of 90° with respect to the writing surface is 0.67 or greater but less than 1.5, and is more preferably 0.9 or greater but less than 1.1.

Note that when this value is less than 0.67, or 1.5 or greater, the width of a drawn line changes, and the writing implement becomes difficult for a user to use under such writing conditions.

Advantageous Effects of Invention

The respective aspects of the present disclosure are configured as described above, thereby enabling the width of a drawn line to be freely changed by writing pressure in a narrow-shafted felt-tip pen or marker pen.

In addition to the above advantageous effect, specific aspects of the present disclosure enable prevention of the phenomenon in which ink that has leaked out at the tip of the ink supply core that guides ink by capillary action runs between the ink supply core and the core surrounding member and rises as far as the interior of the shaft tube.

DETAILED DESCRIPTION OF EMBODIMENTS

Figure 1A:
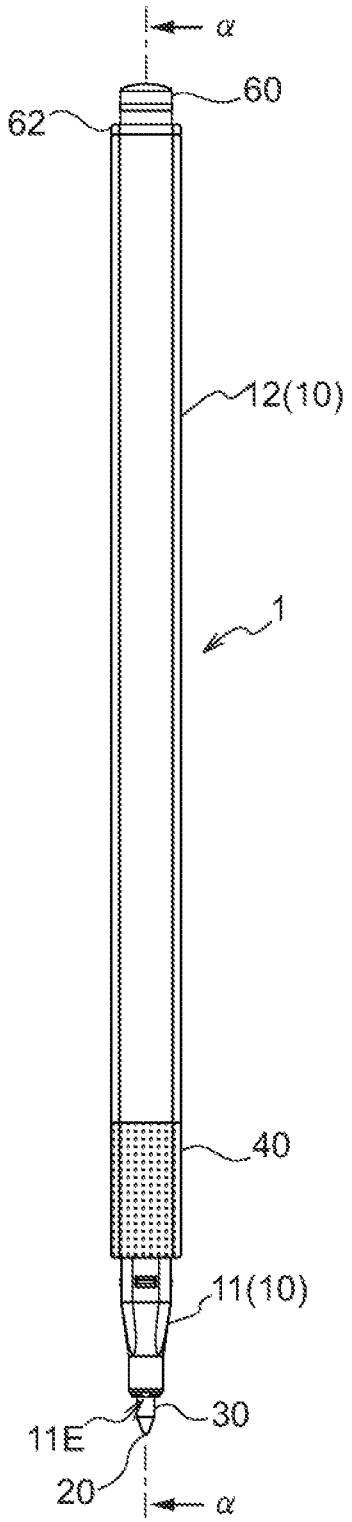
FIG. 1A is a front view illustrating an overall configuration of a writing implement according to a first exemplary embodiment.

Explanation follows regarding a narrow-shafted felt-tip pen or marker pen as an example of a writing implement 1 according to exemplary embodiments, with reference to the drawings. In the drawings, the "front" of the writing implement 1 and its configuration components refers to the direction of a tip of the writing implement 1, and the "rear" refers to the opposite direction thereto. The "axial direction" refers to a direction running through an axis of a shaft tube 10 from front to rear, and the "lateral direction" refers to a direction orthogonal to the axial direction. Unless specifically stated otherwise, common reference numerals in the respective drawings represent the same configurations or components.

Overall Configuration of First Exemplary Embodiment

Figure 1B:
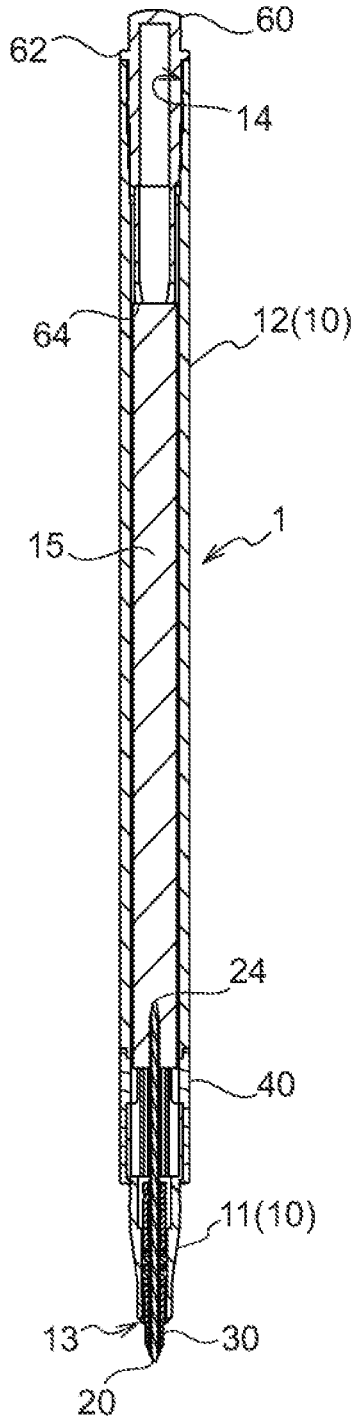
FIG. 1B is a cross-section taken along α-α in FIG. 1A.

As illustrated in FIG. 1A, the writing implement 1 according to a first exemplary embodiment includes the shaft tube 10 integrally formed with a small diameter tip shaft 11 and a larger diameter rear shaft 12 (see FIG. 2), and a core surrounding member 30 fitted to a front side of the tip shaft 11. As illustrated in FIG. 1B, an inner felt 15 in which ink is stored is housed in the interior of the rear shaft 12. A ventilation hole 11E which allows air to pass between the interior and the exterior of the shaft tube 10 is provided in the vicinity of the tip of the tip shaft 11.

The core surrounding member 30 is penetrated by an ink supply core 20. A tip of the ink supply core 20 projects from the tip of the core surrounding member 30. A rear end of the ink supply core 20 extends far enough to stick into a front end of the inner felt 15.

Figure 4A:
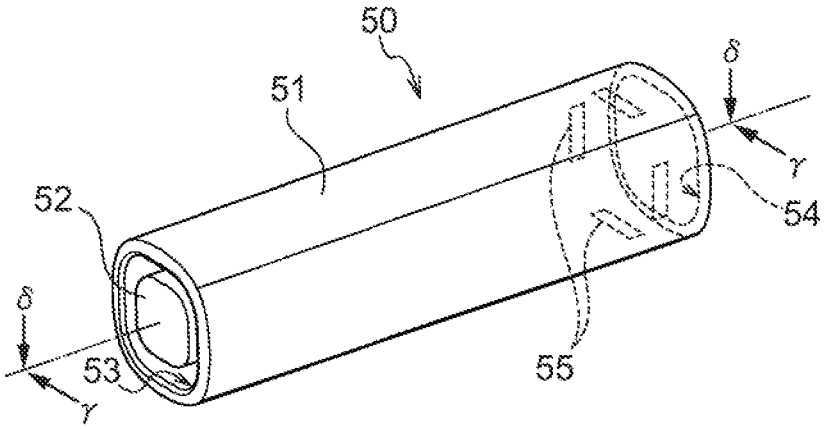
FIG. 4A is a perspective view illustrating a cap of a writing implement according to the first exemplary embodiment.
Figure 4B:
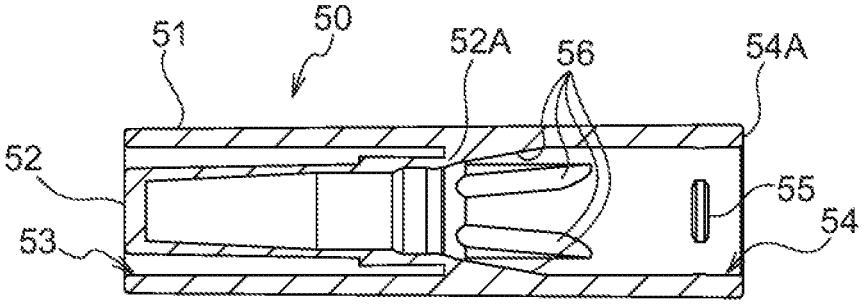
FIG. 4B is a cross-section taken along γ-γ in FIG. 4A.
Figure 4C:
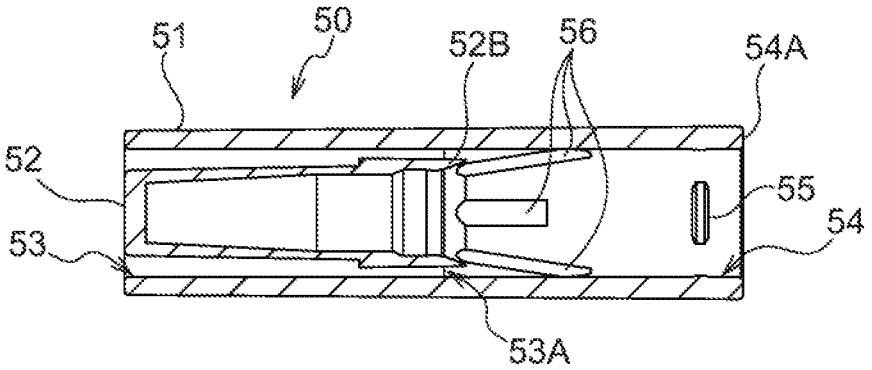
FIG. 4C is a cross-section taken along δ-δ in FIG. 4A.

Although not illustrated in FIG. 1A, a cap 50 illustrated in FIG. 4A to FIG. 4C is fitted to the tip shaft 11 illustrated in FIG. 1A.

Shaft Tube Structure

As illustrated in FIG. 1B, the shaft tube 10 includes the tip shaft 11 and the rear shaft 12, as described above. A front end portion of the tip shaft 11 opens at a front opening 13, and a rear end portion of the rear shaft 12 opens at a rear opening 14. Note that a tail plug 60 is press fitted into the rear opening 14.

Figure 3A:
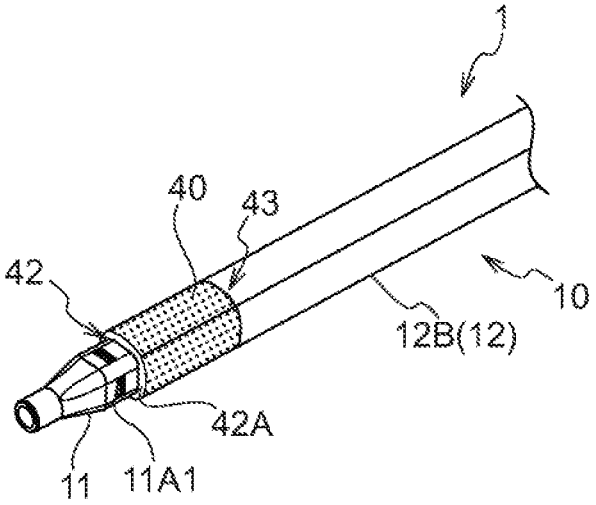
FIG. 3A is a perspective view illustrating a grip member of a writing implement according to the first exemplary embodiment.

As illustrated in FIG. 3A, the external profile of the shaft tube 10 is formed in a round-cornered square shape overall in cross-section taken along the lateral direction.

Figure 2:
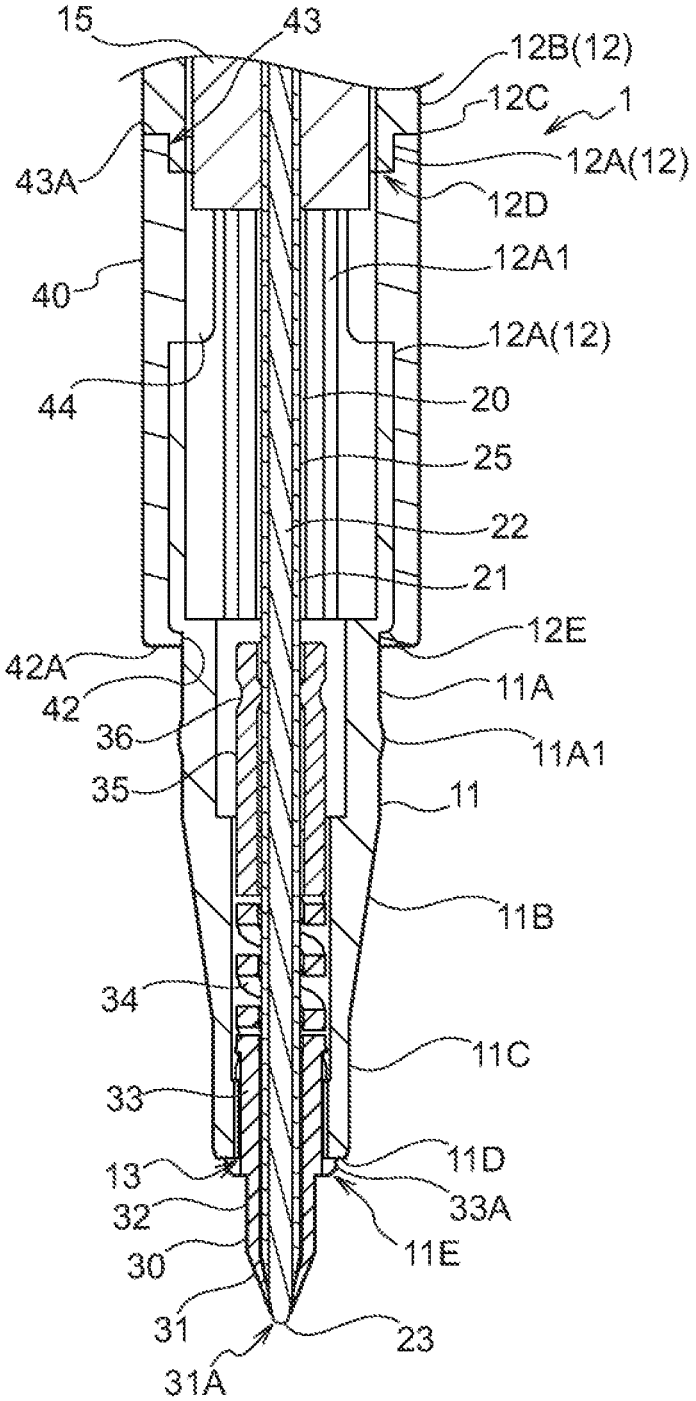
FIG. 2 is an enlarged view of relevant portions in FIG. 1B.

As illustrated in FIG. 2, the rear shaft 12 is integrally formed with a front grip 12A covered by a grip member 40, described later, on the front side, and a rear grip 12B on the rear side.

The front grip 12A and the rear grip 12B include a step where the diameter decreases toward the front at a boundary 12C between the front grip 12A and the rear grip 12B. The thickness of the front grip 12A is accordingly less than the thickness of the rear grip 12B.

Plural grooves 12D, each having a rectangular shape that is long in the axial direction, are provided in part of an outer peripheral face of the front grip 12A. Anchor tabs 44 projecting from an inner face of the grip member 40, described later, are fitted into the grooves 12D.

An end portion 12E at the front of the front grip 12A is formed with circular arc shaped convex face in cross-section taken along the lateral direction. The tip shaft 11 integrally formed in front of the end portion 12E is narrower than the end portion 12E.

A rear edge of the rear shaft 12 contacts a lip 62 of the tail plug 60 (see FIG. 1).

As illustrated in FIG. 2, the tip shaft 11 includes, from the rear end, a base portion 11A, a diameter reduction portion 11B, a tip portion 11C, and an anchor face 11D.

The base portion 11A is a portion that extends toward the front with a uniform thickness from the end portion 12E at the front of the front grip 12A. Note that as illustrated in FIG. 2 and FIG. 3A to FIG. 3C, each side face of an intermediate portion of the base portion 11A is formed with a protrusion running in a direction intersecting the axial direction. These protrusions are referred to as anchor protrusions 11A1. In the present exemplary embodiment, a total of four of the anchor protrusions 11A1 are provided.

The diameter reduction portion 11B is a portion extending so as to taper toward the front from a front end of the base portion 11A.

The tip portion 11C is a portion extending toward the front with a uniform thickness from a front end of the diameter reduction portion 11B.

The anchor face 11D is a tip edge of the tip portion 11C, and contacts an engagement tab 33A of an engagement portion 33 of the core surrounding member 30, described later.

Grip Member

Figure 3B:
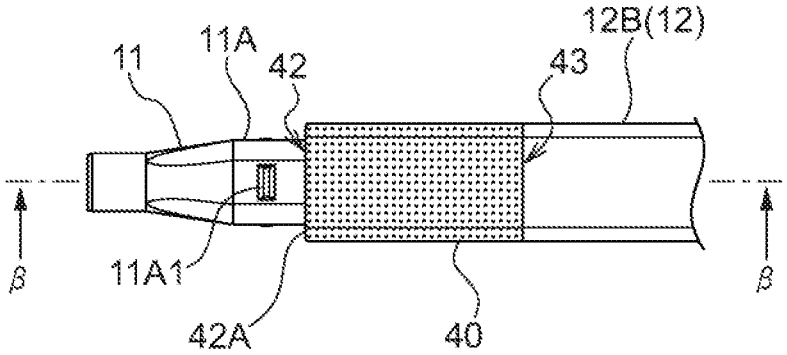
FIG. 3B is a side view illustrating a grip member of a writing implement according to the first exemplary embodiment.
Figure 3C:
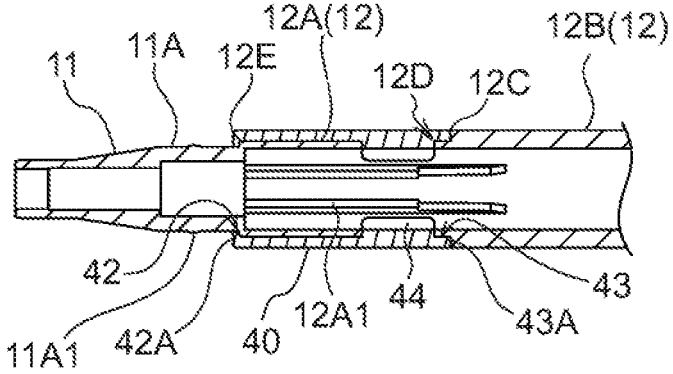
FIG. 3C is a cross-section taken along β-β in FIG. 3B.

As illustrated in FIG. 3A to FIG. 3C, the grip member 40 is formed in a tube shape with a substantially square cross-section overall, and includes a front opening 42 opening at the front, and a rear opening 43 opening at the rear.

The anchor tabs 44 are formed at the inside of the grip member 40 as plural projecting ridges that project toward the inside and are long in the axial direction. The anchor tabs 44 fit into the plural grooves 12D provided at the outer periphery of the front grip 12A of the rear shaft 12 in order to fit the grip member 40 onto the rear shaft 12.

An end portion of the front opening 42 is formed with an edge 42A. An inner face of the edge 42A is formed with a concave circular arc shaped cross-section corresponding to the convex circular arc shaped cross-section of the end portion 12E of the front grip 12A. The front opening 42 is formed with a size allowing the base portion 11A of the tip shaft 11 to be fitted therein.

An end portion of the rear opening 43 is formed with an end face 43A that contacts a step face at the boundary 12C of the rear grip 12B of the rear shaft 12.

As illustrated in FIG. 3A and FIG. 3B, the grip member 40 may be applied with a different color to the shaft tube 10. This color may, for example, be a color related to the ink stored in the inner felt 15.

The shaft tube 10 and the grip member 40 may, for example, be formed by two-color molding.

Cap

As illustrated in FIG. 4A to FIG. 4C and FIG. 5A to FIG. 5C, the cap 50 includes a cap outer tube 51 and a cap inner tube 52.

As illustrated in FIG. 4A, the cap outer tube 51 is formed in a tube shape overall, and is open at the front and rear. The rear opening is referred to as a rear opening 54. An outer peripheral face of the cap outer tube 51 has the same cross-section as the outer peripheral face of the shaft tube 10 as sectioned along the lateral direction, namely being formed in a round-cornered square shape overall.

As illustrated in FIG. 4A to FIG. 4C and FIG. 5A to FIG. 5C, the cap inner tube 52 is formed in a tube shape that is closed off at the tip end and open at the rear end. The cap inner tube 52 is housed in a front half of the interior of the cap outer tube 51, and the open rear end portion is coupled to an inner peripheral face of a substantially intermediate portion of the cap outer tube 51 through non-continuous, evenly spaced coupling portions 52A. Plural through holes 53A are configured between the respective coupling portions 52A. A rear edge of the cap inner tube 52 is configured by non-continuous edges 52B interspersed between the coupling portions 52A. Six of both the coupling portions 52A and the non-continuous edges 52B are formed in the present exemplary embodiment.

The closed tip portion of the cap inner tube 52 lies in the same plane as the tip of the cap outer tube 51, and the periphery thereof is surrounded by a continuous peripheral groove 53. The peripheral groove 53 is in communication with the rear half of the interior of the cap outer tube 51 through the through holes 53A.

The tip shaft 11 described above (see FIG. 1A, FIG. 1B, and FIG. 3A to FIG. 3C) is inserted through the rear opening 54.

Plural anchor protrusions 55 are formed protruding so as to intersect the axial direction in the vicinity of the rear end of the inner face of the cap outer tube 51. The anchor protrusions 55 undergo elastic deformation on progression from front to rear so as to ride over and anchor to the anchor protrusions 11A1 provided to the tip shaft 11 (see FIG. 2 and FIG. 3A to FIG. 3C). The cap 50 is thereby fitted to the shaft tube 10.

As illustrated in FIG. 4A, the plural anchor protrusions 55 of the present exemplary embodiment are provided corresponding to the rounded side faces of the cap outer tube 51, and so a total of four thereof are provided.

As illustrated in FIG. 4B and FIG. 4C, plural guide tabs 56 are formed as inclined projecting ridges that couple from the coupling portions 52A to the inner face of the cap outer tube 51. In the present exemplary embodiment, a total of six of the plural guide tabs 56 are evenly disposed.

Figure 5A:
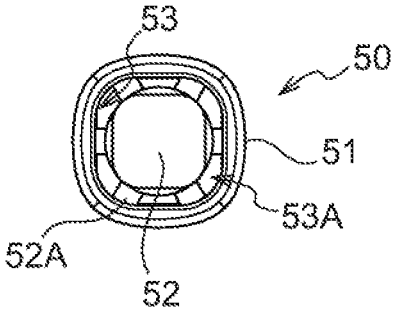
FIG. 5A is a plan view illustrating a head of a cap of a writing implement according to the first exemplary embodiment.
Figure 5B:
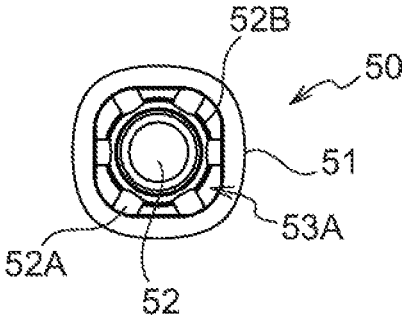
FIG. 5B is a bottom face view (B) illustrating an insertion portion of a cap of a writing implement according to the first exemplary embodiment.
Figure 5C:
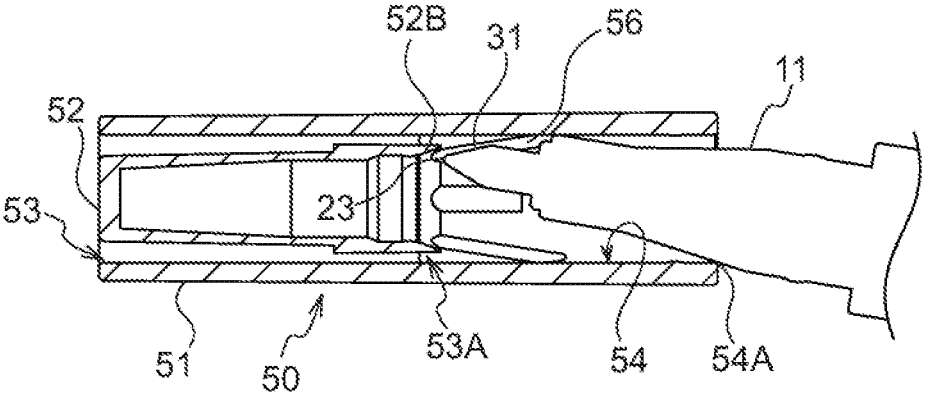
FIG. 5C is a side view cross-section illustrating a state in which a tip shaft is being inserted to a cap of a writing implement according to the first exemplary embodiment.

As illustrated in FIG. 5C, the plural guide tabs 56 prevent damage during insertion of the tip shaft 11 through the rear opening 54 of the cap 50 so as to slide against an inner peripheral edge 54A of the rear opening 54, by guiding a diameter reduction portion 31 of the core surrounding member 30 and a tip portion 23 of the ink supply core 20 such that the diameter reduction portion 31 and the tip portion 23 avoid hitting the non-continuous edges 52B.

Tail Plug

Figure 6A:
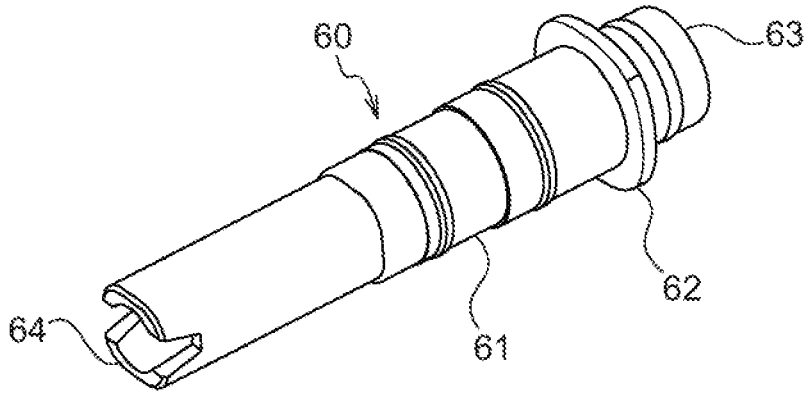
FIG. 6A is a perspective view illustrating a tail plug of a writing implement according to the first exemplary embodiment.
Figure 6B:
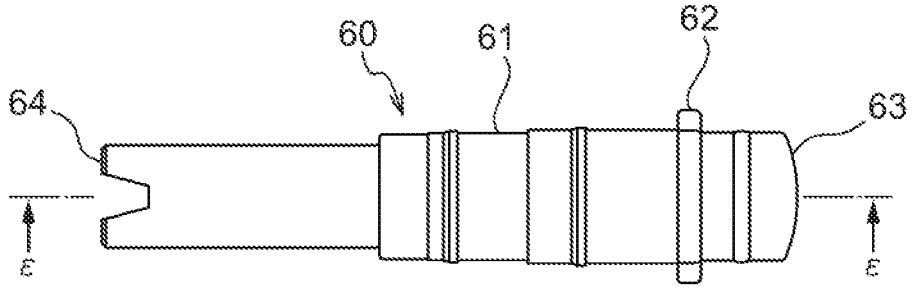
FIG. 6B is a side view illustrating a tail plug of a writing implement according to the first exemplary embodiment.
Figure 6C:
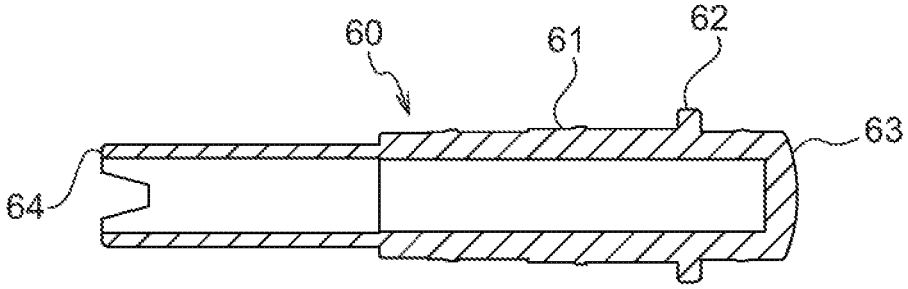
FIG. 6C is a cross-section taken along ε-ε in FIG. 6B.

As illustrated in FIG. 6A to FIG. 6C, the tail plug 60 is formed in a tube shape overall, and includes an insertion portion 61, the lip 62, and a head 63. A tip end of the insertion portion 61 configures a tail portion 64.

The insertion portion 61 is inserted into the interior of the rear shaft 12 through the rear opening 14 of the rear shaft 12 of the shaft tube 10 so as to block the rear opening 14 (see FIG. 1).

The lip 62 tightly closes off the interior of the rear shaft 12 by making close contact with an end face of the rear opening 14, thereby isolating the interior of the rear shaft 12 from external air.

The head 63 is formed extending from the lip 62 toward the rear, and the cap 50 can be fitted on the head 63 during writing.

In lateral direction cross-section, the tail plug 60 is formed with a circular profile at the insertion portion 61 and the head 63. However, a cross-section profile of the lip 62 is formed in the same round-cornered square shape as the lateral direction cross-section profile of the shaft tube 10. Namely, the profiles are matched such that the lip 62 and the rear shaft 12 have the same profile as each other when the tail plug 60 is inserted into the rear opening 14 of the shaft tube 10.

Note that another writing instrument, not illustrated in the drawings, may be fitted in place of the tail plug 60. By configuring the external profile of such another writing instrument with the same profile as the insertion portion 61 of the tail plug 60 at a portion that is inserted into the rear shaft 12, the shaft tube 10 may be employed either with the writing implement 1 that has a writing tip at one end only, as in the present exemplary embodiment, or with a writing implement that has writing tips at both ends.

Inner Felt

As illustrated in FIG. 1B, the inner felt 15 is configured in a circular tube shape by a polyester fiber material that stores ink, and is housed inside the rear shaft 12 of the shaft tube 10.

As illustrated in FIG. 2, a front end portion of the inner felt 15 is positioned slightly further to the front than the boundary 12C so as to be inside the front grip 12A of the rear shaft 12, and contacts plural ribs 12A1 (see FIG. 3C) formed along the axial direction at an inner peripheral face of the front grip 12A.

A rear end portion of the inner felt 15 is at a position contacting the tail portion 64 of the tail plug 60 fitted into the rear shaft 12.

As illustrated in FIG. 1B, the inner felt 15 is fixed sandwiched between the ribs 12A1 of the front grip 12A and the tail portion 64 of the tail plug 60.

Configuration of Relevant Portions

Detailed explanation follows regarding the ink supply core 20 and the core surrounding member 30, these being relevant portions of the present exemplary embodiment.

Ink Supply Core

As illustrated in FIG. 2, the ink supply core 20 includes an outer peripheral portion 21, a flow path 22, the tip portion 23, a rear end portion 24 (see FIG. 1), and a body 25.

The ink supply core 20 is formed by extrusion molding a polyacetal resin, and has a substantially circular tube shaped profile overall from the front side to the rear side. The tip portion 23 has a circular conical profile that decreases in diameter toward the front, and the rear end portion 24 has a circular conical profile that decreases in diameter toward the rear. The body 25 is interposed between the tip portion 23 and the rear end portion 24, and is configured with a circular tube shaped profile having the same external diameter as the external diameter of the locations of the tip portion 23 and the rear end portion 24 from where the diameter reduction begins. The ink supply core 20 may be configured by a bundled fiber core, a sintered core, or the like.

Outer Peripheral Portion

The outer peripheral portion 21 configures an outer face of the ink supply core 20. A tip of the tip portion 23 and a tip of the rear end portion 24 of the outer peripheral portion 21 are formed such that the flow path 22, described below, is exposed.

Flow Path

The flow path 22 is formed along the axial center of the interior of the outer peripheral portion 21. As described above, the flow path 22 is exposed at the tip portion 23 and the rear end portion 24 of the outer peripheral portion 21.

During extrusion molding of the ink supply core 20, a die provided with a narrow gap at a central portion is employed to form the flow path 22 as a narrow gap at a cross-section central portion of the ink supply core 20. The flow path 22 configured by the gap exhibits capillary action and retains ink. In this case, the outer peripheral portion 21 and the flow path 22 are integrally formed in the ink supply core 20.

Figure 10A:
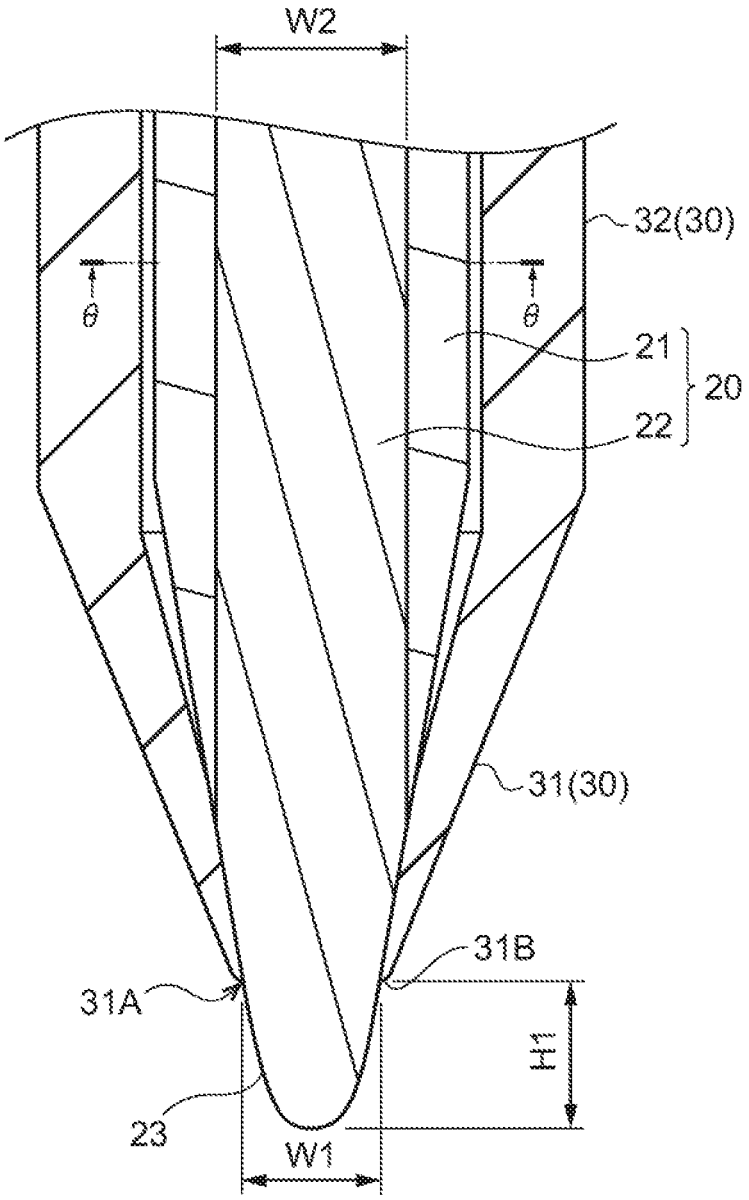
FIG. 10A is an enlarged cross-section illustrating a tip portion of a writing implement according to the first exemplary embodiment.

In the cross-section in FIG. 10A, the flow path 22 is formed as a portion running along the axial center, namely a portion taking up an external diameter W2, and a portion at the periphery of the flow path 22 is the outer peripheral portion 21.

Figure 10B:
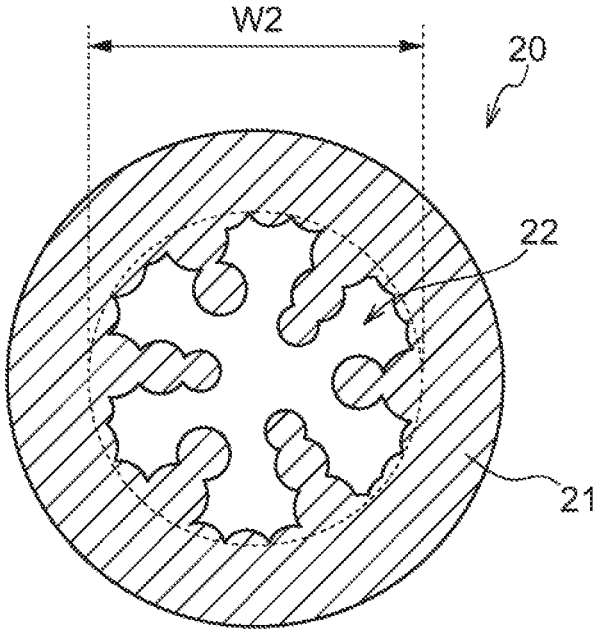
FIG. 10B is a cross-section taken along θ-θ illustrating an example of the ink supply core in FIG. 10A.

For example, the flow path 22 is formed as a region where an inner peripheral edge includes irregularly-shaped cavities at an axial center portion, such as in the cross-section of the ink supply core 20 illustrated in FIG. 10B. The external diameter W2 of the flow path is set as the diameter of an imaginary circle circumscribing the cavities. The flow path 22 may also be formed as a region including branching cavities that are narrower than those of the flow path 22 illustrated in FIG. 10B, as in another example illustrated in the cross-section of FIG. 10C. In this other example, the external diameter W2 of the flow path is larger, and the proportion of the cross-section of the ink supply core 20 taken up by the flow path 22 is higher than in the example illustrated in FIG. 10B.

Note that in cases in which the flow path 22 is formed by a bundled fiber core or a sintered core having a capillary structure, the outer peripheral portion 21 can be configured with a structure formed by coating the outer face of the flow path 22, such that the outer peripheral portion 21 configures a thickened portion of the ink supply core 20 at the outside of the flow path 22, thereby enabling the outer face of the flow path 22 to be fixed to the core surrounding member 30 without being exposed.

In the ink supply core 20, ink stored in the inner felt 15 is guided to the tip portion 23 by capillary action through the rear end portion 24 that is inserted into the inner felt 15.

Core Surrounding Member

Figure 7A:
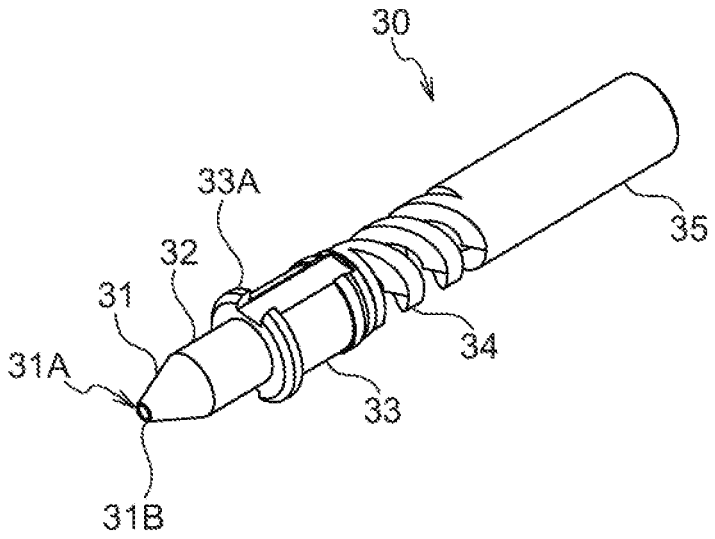
FIG. 7A is a perspective view illustrating a core surrounding member of a writing implement according to the first exemplary embodiment.
Figure 7B:
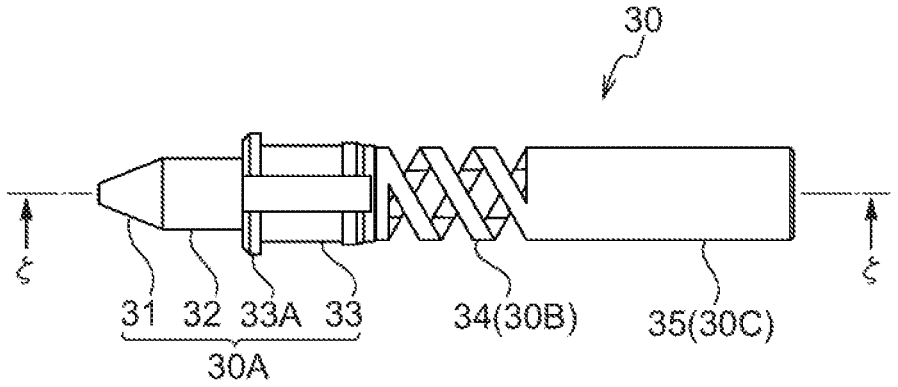
FIG. 7B is a side view illustrating a core surrounding member of a writing implement according to the first exemplary embodiment.
Figure 7C:
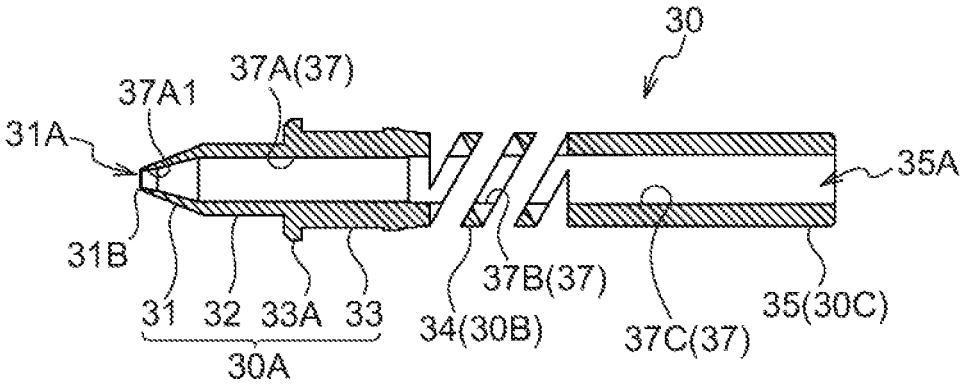
FIG. 7C is a cross-section taken along ζ-ζ in FIG. 7B.

As illustrated in FIG. 7A to FIG. 7C, the core surrounding member 30 includes a tip portion 30A, a central portion 30B, and a rear end portion 30C in sequence from the front side toward the rear side.

The tip portion 30A includes the diameter reduction portion 31, a circular tube portion 32, and an engagement portion 33. The central portion 30B is configured by an elastic portion 34. The rear end portion 30C is configured by a tube portion 35.

A through portion 37 is provided penetrating these portions from the tip to the rear end. The ink supply core 20 penetrates the through portion 37 as illustrated in FIG. 2.

In the present exemplary embodiment, the diameter reduction portion 31, the circular tube portion 32, the engagement portion 33, the elastic portion 34, and the tube portion 35 are integrally formed to each other, and, with the exception of the diameter reduction portion 31, each has a basically circular tube shaped profile.

From the perspectives of friction reduction during writing, wear reduction, and creep reduction of the elastic portion 34, the core surrounding member 30 is preferably formed from a polyacetal resin.

Diameter Reduction Portion

As illustrated in FIG. 7C, the diameter reduction portion 31 is positioned at the front side of the core surrounding member 30, and is formed with a tapered profile such that the diameter decreases on progression toward the front.

A circular tip opening 31A is formed at the tip of the diameter reduction portion 31, and an opening-peripheral edge 31B is formed about the periphery of the tip opening 31A. In the diameter reduction portion 31, the through portion 37 configures a first through portion 37A.

The first through portion 37A includes a stopper face 37A1 that decreases in diameter on progression toward the tip opening 31A. A side face of the tip portion 23 of the ink supply core 20 described above contacts and is anchored to the stopper face 37A1, such that the tip of the tip portion 23 of the ink supply core 20 projects to the exterior (see FIG. 2).

As illustrated in FIG. 7C, the internal diameter of the first through portion 37A in the diameter reduction portion 31 increases on progression from the tip opening 31A toward the rear. The profile of the first through portion 37A corresponds to the circular conical profile of the outer peripheral face of the tip portion 23 of the ink supply core 20.

Circular Tube Portion

As illustrated in FIG. 7A to FIG. 7C, the circular tube portion 32 is formed with a circular tube shape extending continuously from the rear side of the diameter reduction portion 31 toward the rear side, and has the same external diameter as the external diameter of the rear end of the diameter reduction portion 31.

The first through portion 37A continues on from the diameter reduction portion 31 to configure the through portion 37 in the circular tube portion 32.

The first through portion 37A in the circular tube portion 32 is formed as a hole with a circular cross-section profile having the same internal diameter as the internal diameter of the rear end of the first through portion 37A in the diameter reduction portion 31. The first through portion 37A in the circular tube portion 32 is applied with a larger internal diameter than the external diameter of the ink supply core 20, thereby enabling the ink supply core 20 to move along the axial direction.

Engagement Portion

As illustrated in FIG. 7A to FIG. 7C, the engagement portion 33 is provided so as to continue from the rear end of the circular tube portion 32 across the circular disc shaped engagement tab 33A that has a larger external diameter than the external diameter of the circular tube portion 32. The external diameter of the engagement portion 33 is larger than the external diameter of the circular tube portion 32, and smaller than the external diameter of the engagement tab 33A. The engagement portion 33 is formed in a substantially circular tube shape, and a side face of the engagement portion 33 is locally notched along the axial direction.

As illustrated in FIG. 7C, the first through portion 37A that penetrates the circular tube portion 32 is formed with the same internal diameter at the interior of the engagement portion 33, and continues extending toward the rear as a circular hole.

Elastic Portion

As illustrated in FIG. 7A to FIG. 7C, in the present exemplary embodiment the elastic portion 34 is formed by a double coil spring that continues from the rear side of the engagement portion 33 and has substantially the same external diameter as the external diameter of the rear end of the engagement portion 33. The coil spring has a triangular cross-section profile, as illustrated in FIG. 7C.

As illustrated in FIG. 7C, at the interior of the coil spring 34, a second through portion 37B is formed continuing from the rear end of the first through portion 37A. The second through portion 37B has substantially the same internal diameter as the internal diameter of the first through portion 37A, and is formed as a circular hole extending toward the rear.

Note that the coil spring is one example of the profile of the elastic portion 34.

The coil spring serving as the elastic portion 34 is formed with a predetermined spring constant adapted for a fine felt-tip pen or marker pen. The ink supply core 20 is applied with a degree of biasing force that allows axial direction movement of the ink supply core 20, described later.

Tube Portion

As illustrated in FIG. 7A to FIG. 7C, the tube portion 35 continues from the rear end of the elastic portion 34, has substantially the same external diameter as the external diameter of the elastic portion 34, and has a circular tube shape extending toward the rear.

At the interior of the tube portion 35, a third through portion 37C is formed continuing from the second through portion 37B in the elastic portion 34 as a circular hole extending toward the rear with substantially the same internal diameter. The rear end of the tube portion 35 is open at a rear opening 35A.

In this manner, the core surrounding member 30 is configured from plural locations on progression from front to rear, and the ink supply core 20 is inserted into the first through portion 37A, the second through portion 37B, and the third through portion 37C through the rear opening 35A at the rear side of the core surrounding member 30.

Figure 8A:
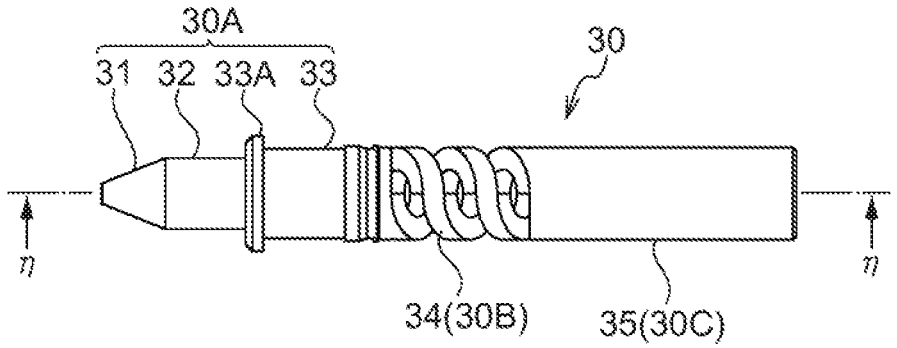
FIG. 8A is a side view illustrating a modified example of a core surrounding member of a writing implement according to the first exemplary embodiment.
Figure 8B:
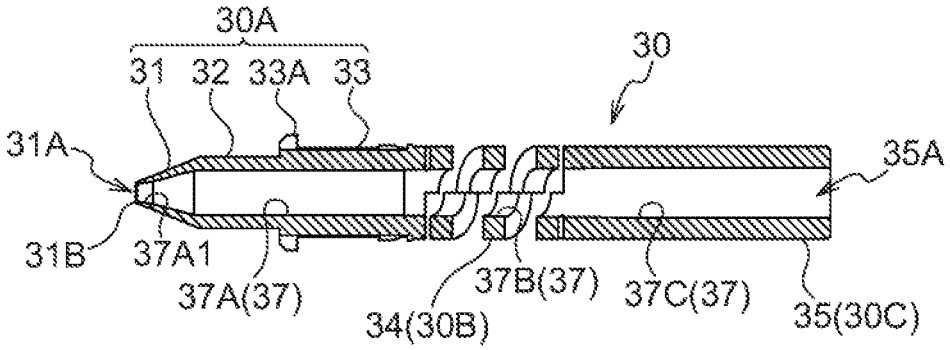
FIG. 8B is a cross-section taken along η-η in FIG. 8A.

The profile of the coil spring configuring the elastic portion 34 is not limited to the above, and, for example, may have a square cross-section profile as illustrated in FIG. 8A and FIG. 8B.

Fixing of Ink Supply Core to Core Surrounding Member

Explanation follows regarding fixing together of the ink supply core 20 and the core surrounding member 30.

As described above, the ink supply core 20 penetrates the through portion 37 (the first through portion 37A, the second through portion 37B, and the third through portion 37C) of the core surrounding member 30.

Figure 9A:
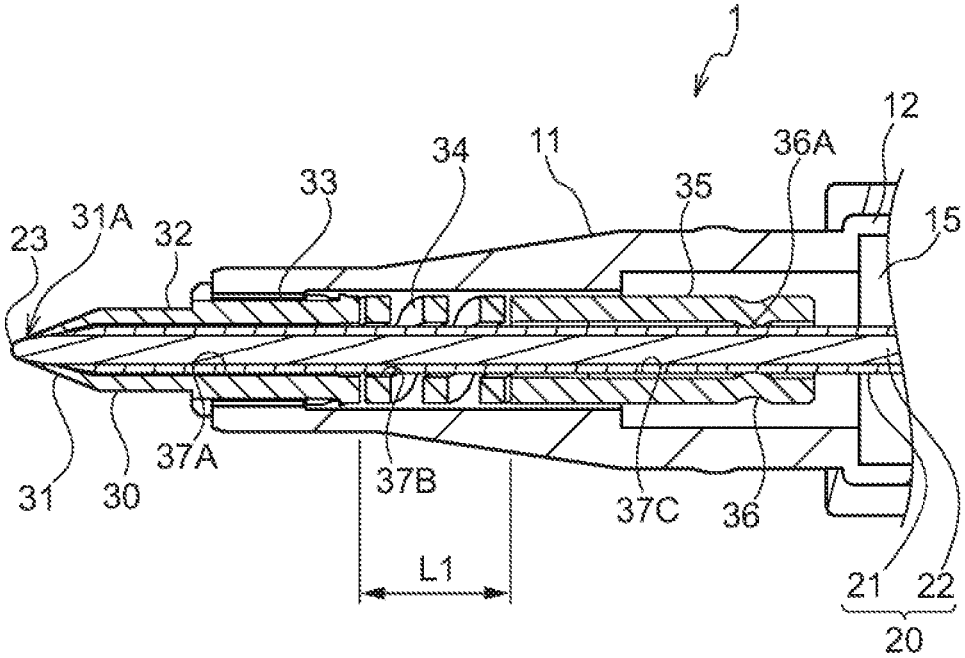
FIG. 9A is a cross-section illustrating a state of an ink supply core and a core surrounding member of a writing implement according to the first exemplary embodiment prior to being used.
Figure 9B:
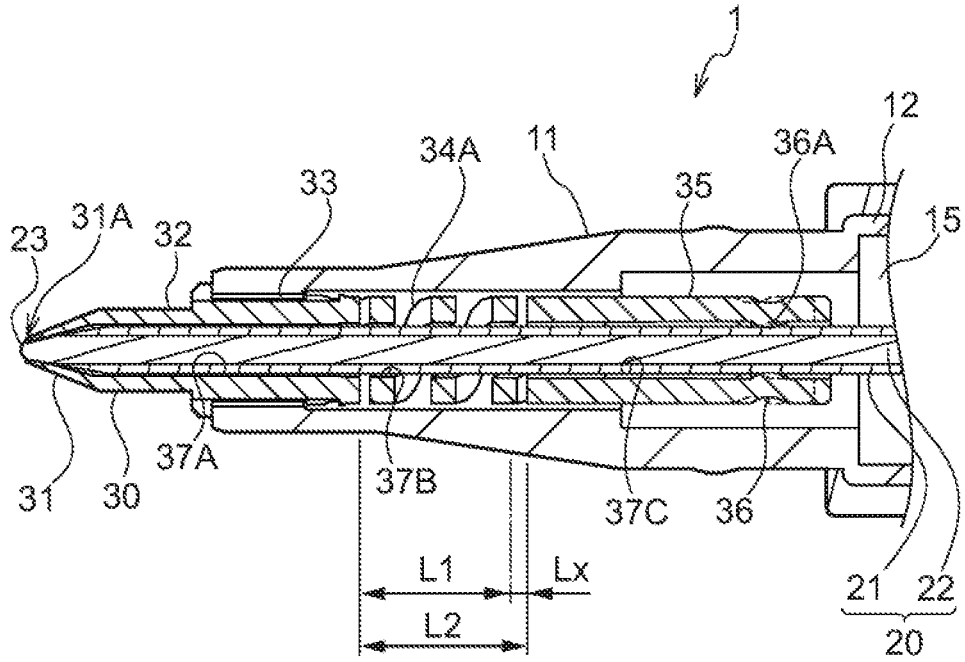
FIG. 9B is a cross-section illustrating a state of an ink supply core and a core surrounding member of a writing implement according to the first exemplary embodiment when in use.

In the present exemplary embodiment, as illustrated in FIG. 9A and FIG. 9B, the ink supply core 20 is fixed by employing a punch to perform impact deformation to compress a punch-fixed portion 36 at an outer peripheral face of the tube portion 35 configuring the rear end portion 30C of the core surrounding member 30, such that a protrusion 36A formed to an inner face of the tube portion 35 presses against and is fixed to an outer peripheral face of the ink supply core 20.

Namely, the ink supply core 20 and the core surrounding member 30 are only fixed to each other at the rear end portion 30C of the core surrounding member 30, and the tip portion 30A and the central portion 30B are not fixed.

Accordingly, the ink supply core 20 is not fixed to, and is capable of moving inside, the first through portion 37A of the tip portion 30A or the second through portion 37B of the central portion 30B.

Note that when a large load acts on the ink supply core 20 during writing, the ink supply core 20 retreats and a cushioning effect is obtained, enabling snapping of the ink supply core 20 to be prevented.

Operation of Relevant Portions

Explanation follows regarding the ability of the ink supply core 20 to retract into the core surrounding member 30 under writing pressure obtained through the configuration of the writing implement 1 described above, with reference to FIG. 2, FIG. 9A, FIG. 9B, and FIG. 10A.

The writing implement 1 of the present exemplary embodiment includes the ink supply core 20 and the core surrounding member 30, and the ink supply core 20 is configured to retract under writing pressure at the tip of the core surrounding member 30.

The operation of the writing implement 1 to enable the width of a drawn line to be changed freely according to the writing pressure is described next.

First, when intending to write with a fine line, a predetermined writing pressure or lower is applied to the writing implement 1. When this is performed, as illustrated in FIG. 9A and FIG. 10A, the tip portion 23 of the ink supply core 20 is at a position projecting by a predetermined length (for example, around 0.1 mm) from the tip opening 31A of the core surrounding member 30. The tip portion 23 of the ink supply core 20 is capable of drawing a line on paper or the like, not illustrated in the drawings, when at this position.

When this is performed, as illustrated in FIG. 9A, the elastic portion 34 configured by a coil spring is maintained in a state at a length L1, and the ink supply core 20 does not retract.

Next, when intending to write with a broader line, writing pressure greater than the predetermined writing pressure is applied to the writing implement 1.

As illustrated in FIG. 9B, the ink supply core 20 is fixed inside the third through portion 37C of the tube portion 35 of the core surrounding member 30 by the protrusion 36A of the tube portion 35 (rear end portion 30C).

The ink supply core 20 is not fixed inside the first through portion 37A or the second through portion 37B of the tip portion 30A and central portion 30B of the core surrounding member 30. Accordingly, when applied with writing pressure, the ink supply core 20 attempts to retract.

When this occurs, the ink supply core 20 that is fixed to the tube portion 35 of the core surrounding member 30 pushes the tube portion 35 toward the rear against the biasing force of the elastic portion 34, and as illustrated in FIG. 9B, the length L1 of the elastic portion 34 is elongated by a length Lx to become a length L2.

The coil spring configuring the coil spring 34 is set with an elongatable spring constant corresponding to the writing pressure applied to the ink supply core 20 when intending to write with a broad line (this being greater than the writing pressure applied to the ink supply core when intending to write with a fine line).

The tip portion 23 of the ink supply core 20 accordingly retracts slightly such that the tip of the tip portion 23 still projects from the tip opening 31A of the core surrounding member 30, thereby forming a slight gap between the tip portion 23 and the opening-peripheral edge 31B surrounding the periphery of the tip opening 31A.

Ink is also supplied through the slight gap formed between the tip portion 23 of the ink supply core 20 and the opening-peripheral edge 31B surrounding the periphery of the tip opening 31A. At the same time, the tip portion 23 of the ink supply core 20 and the opening-peripheral edge 31B of the core surrounding member 30 contact the non-illustrated paper or the like at the same time, enabling a broader line to be drawn.

In this manner, the writing implement 1 of the present exemplary embodiment enables the thickness of a drawn line to be changed in a felt-tip pen or marker pen including the ink supply core 20 for writing fine characters.

Moreover, since the ink supply core 20 is capable of moving if applied with excessive writing pressure, load acts on the core surrounding member 30, enabling poor writing due to buckling or squashing of the ink supply core 20 to be prevented.

Projection Dimension of Tip Portion of Ink Supply Core from Tip Opening of Core Surrounding Member Explanation follows regarding a relationship concerning the projection dimension of the tip portion of the ink supply core from the tip opening of the core surrounding member.

A projection dimension H1 (see FIG. 10A) of the tip portion 23 of the ink supply core 20 from the tip opening 31A of the core surrounding member 30 is from 0.05 mm to 0.7 mm when not writing.

This projection dimension is more preferably in a range of 0.1 mm to 0.3 mm, and is most preferably 0.2 mm.

If the projection dimension is less than 0.05 mm, it becomes difficult to write a line. If the projection dimension exceeds 0.7 mm, the distance between the ink supply core 20 and the core surrounding member 30 increases, this being a cause of scratchiness, and increases the likelihood of snapping or buckling of the ink supply core 20 under writing pressure.

Relationship between Internal Diameter of Tip Opening of Core Surrounding Member and External Diameter of Flow Path of Ink Supply Core Table 1 illustrates the results of testing to investigate the scratchiness of drawn lines using plural types of ink, in which the internal diameter of the tip opening 31A of the core surrounding member 30, through which the tip portion 23 of the ink supply core 20 projects, is labeled W1 (mm), and the external diameter of the flow path of the ink supply core 20 is labeled W2 (mm). Two types of black ink (ink A and ink B) employed in products of the present applicant were employed. Ink A exhibits surface tension of 50 m/N, and has a viscosity of 2.0 mPa·s. Ink B exhibits surface tension of 35 m/N, and has a viscosity of 4.0 mPa·s. Note that in Table 1, lines drawn by the inventors as five approximately circular swirls with a diameter of approximately 5 cm were evaluated. These drawn lines were graded "A" if no scratchiness was observed, "B" if slight scratchiness was observed, and "C" if clear scratchiness was present.

TABLE 1

| Example/ comparative example | W1 (mm) | W2 (mm) | W1 − W2 (mm) | Scratchiness in drawn line Ink A | Ink B |
|---|---|---|---|---|---|
| Example 1 | 0.95 | 0.49 | 0.46 | B | B |
| Example 2 | 0.55 | 0.49 | 0.06 | A | B |
| Example 3 | 0.47 | 0.49 | −0.02 | A | A |
| Example 4 | 0.47 | 0.56 | −0.09 | A | A |
| Comparative example | 1.00 | 0.49 | 0.51 | B | C |

Example 1

In Example 1, W1=0.95 mm, and W2=0.49 mm. This resulted in W1-W2=0.46 mm. Regarding the drawn lines, slight scratchiness was observed.

Example 2

In Example 2, W1=0.55 mm, and W2=0.49 mm. This resulted in W1-W2=0.06 mm. Regarding the drawn lines, out of the two ink types for which slight scratchiness was seen in in Example 1, scratchiness was improved for one type (ink A), and so performance was deemed to be better overall than that of Example 1.

Example 3

In Example 3, W1=0.47 mm, and W2=0.49 mm. This resulted in W1-W2=−0.02 mm, this being a value less than zero. Regarding the drawn lines, a good result was obtained in which scratchiness was not observed in any of the ink types used.

Example 4

In Example 4, W1=0.47 mm, and W2=0.56 mm. This resulted in W1-W2=−0.09 mm. Evaluation was almost the same as that for Example 3, and the best result was obtained out of any of the Examples.

Comparative Example

In the Comparative Example, W1=1.0 mm, and W2=0.49 mm. This resulted in W1-W2=0.51 mm, this being a value greater than 0.5 mm. Regarding the drawn lines, scratchiness was observed in the lines drawn using both ink types, with scratchiness being more obvious in one type (ink B). In conclusion, this was deemed undesirable.

In this manner, it was found that scratchiness in drawn lines was only slight if present at all when the value obtained by subtracting the external diameter W2 of the flow path of the ink supply core 20 from the internal diameter W1 of the tip opening 31A of the core surrounding member 30 from which the tip portion 23 of the ink supply core 20 projects was (W1-W2) 0.5 mm or less, and scratchiness was not observed when this value was less than zero.

Regarding the relationship between the internal diameter W1 of the tip opening 31A of the core surrounding member 30 and the external diameter W2 of the flow path 22 of the ink supply core 20, from the above results, it can be seen that it is desirable for the value obtained by subtracting the external diameter W2 of the flow path of the ink supply core 20 from the internal diameter W1 of the tip opening 31A of the core surrounding member 30 from which the tip portion 23 of the ink supply core 20 projects to be 0.5 mm or less, and more desirable for this value to be less than zero.

Overall Configuration of Second Exemplary Embodiment

Figure 11A:
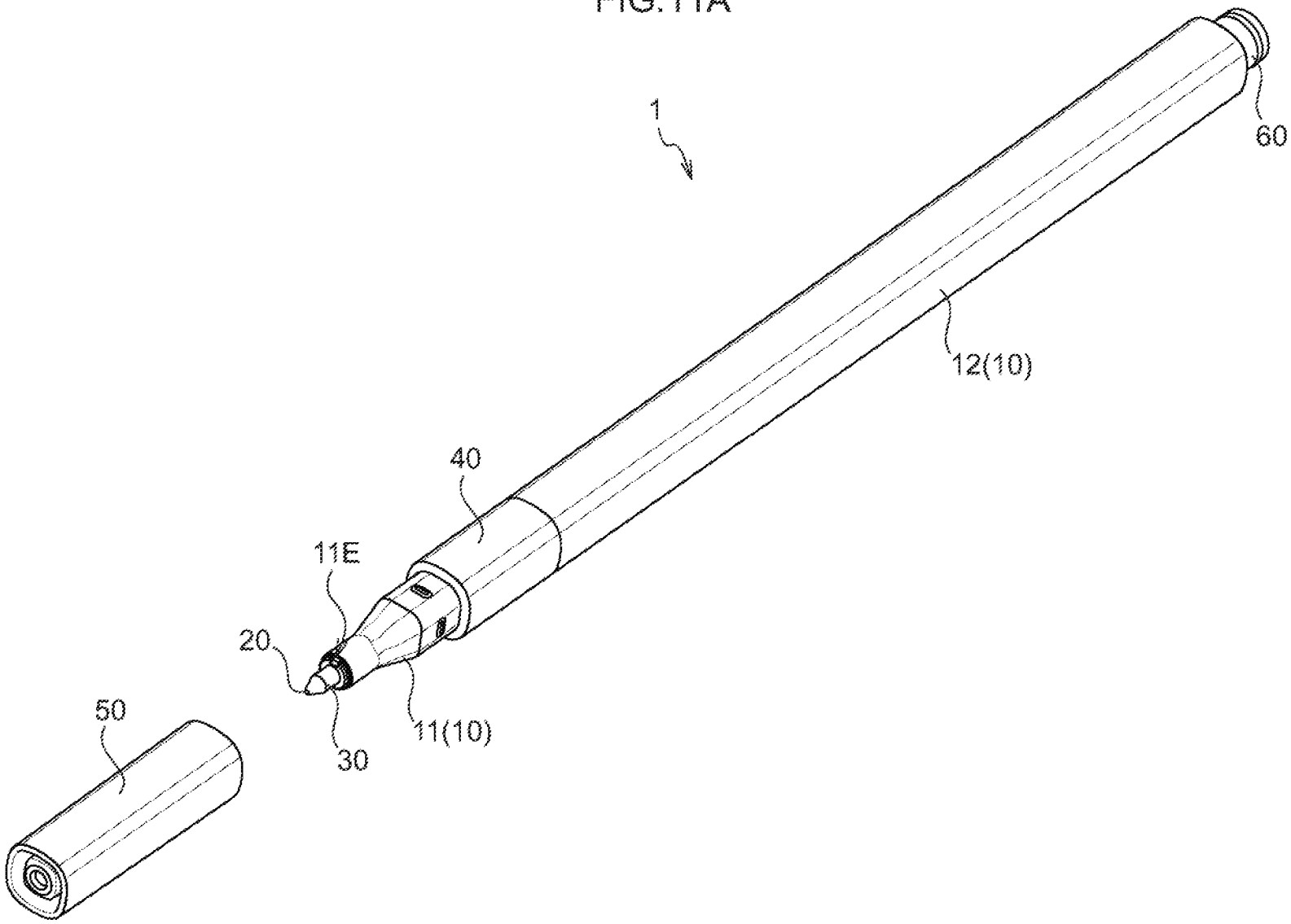
FIG. 11A is a perspective view illustrating an overall configuration of a writing implement according to a second exemplary embodiment.

As illustrated in FIG. 11A, a writing implement 1 according to a second exemplary embodiment includes a shaft tube 10 integrally formed with a small diameter tip shaft 11 and a larger diameter rear shaft 12 (see FIG. 12), and a core surrounding member 30 fitted to a front side of the tip shaft 11. As illustrated in FIG. 11C, an inner felt 15 in which ink is stored is housed in the interior of the rear shaft 12. A ventilation hole 11E which allows air to pass between the interior and the exterior of the shaft tube 10 is provided in the vicinity of the tip of the tip shaft 11.

The core surrounding member 30 is penetrated by an ink supply core 20. A tip of the ink supply core 20 projects from the tip of the core surrounding member 30. A rear end of the ink supply core 20 extends far enough to stick into a front end of the inner felt 15.

Figure 11B:
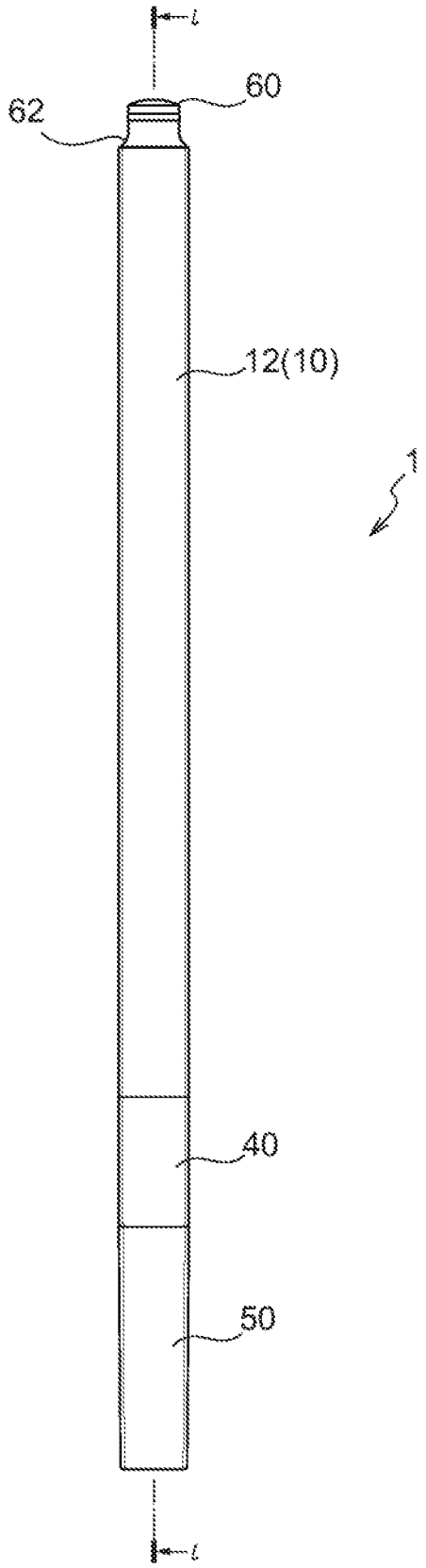
FIG. 11B is a front view illustrating an overall configuration of a writing implement according to the second exemplary embodiment.
Figure 11C:
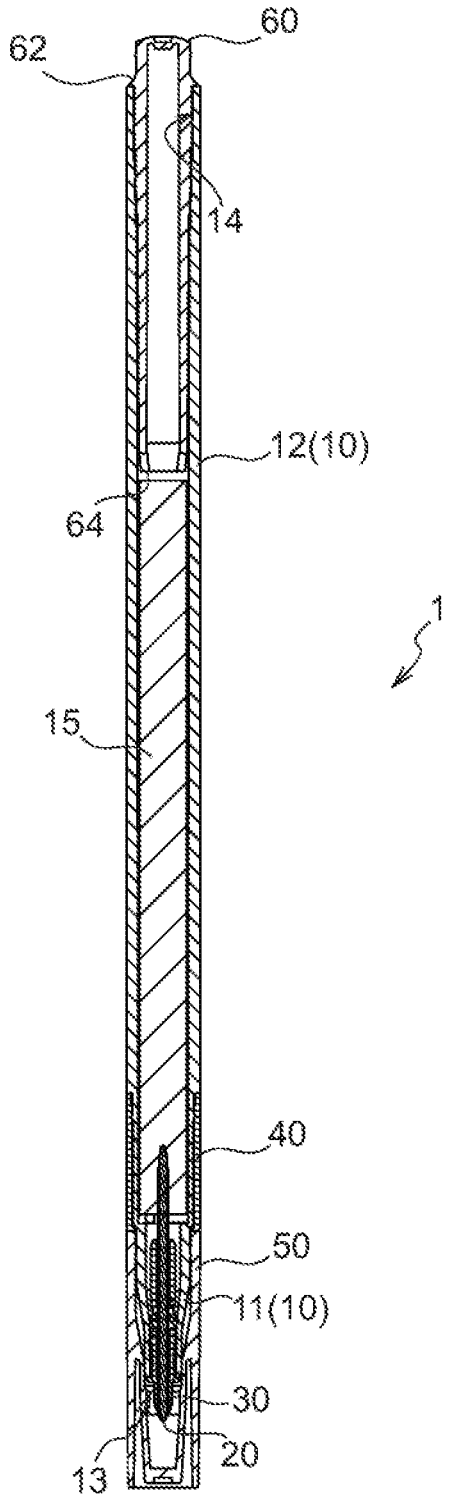
FIG. 11C is a cross-section taken along ι-ι in FIG. 11B.

A cap 50 is fitted to the tip shaft 11 illustrated in FIG. 11A to exhibit the external appearance illustrated in FIG. 11B when not in use.

Shaft Tube Structure

As illustrated in FIG. 11C and FIG. 14A to FIG. 14E (or FIG. 15A to FIG. 15E), the shaft tube 10 includes the tip shaft 11 and the rear shaft 12, as described above. A front end portion of the tip shaft 11 opens at a front opening 13, and a rear end portion of the rear shaft 12 opens at a rear opening 14. Note that a tail plug 60 is press fitted into the rear opening 14.

Figure 14A:
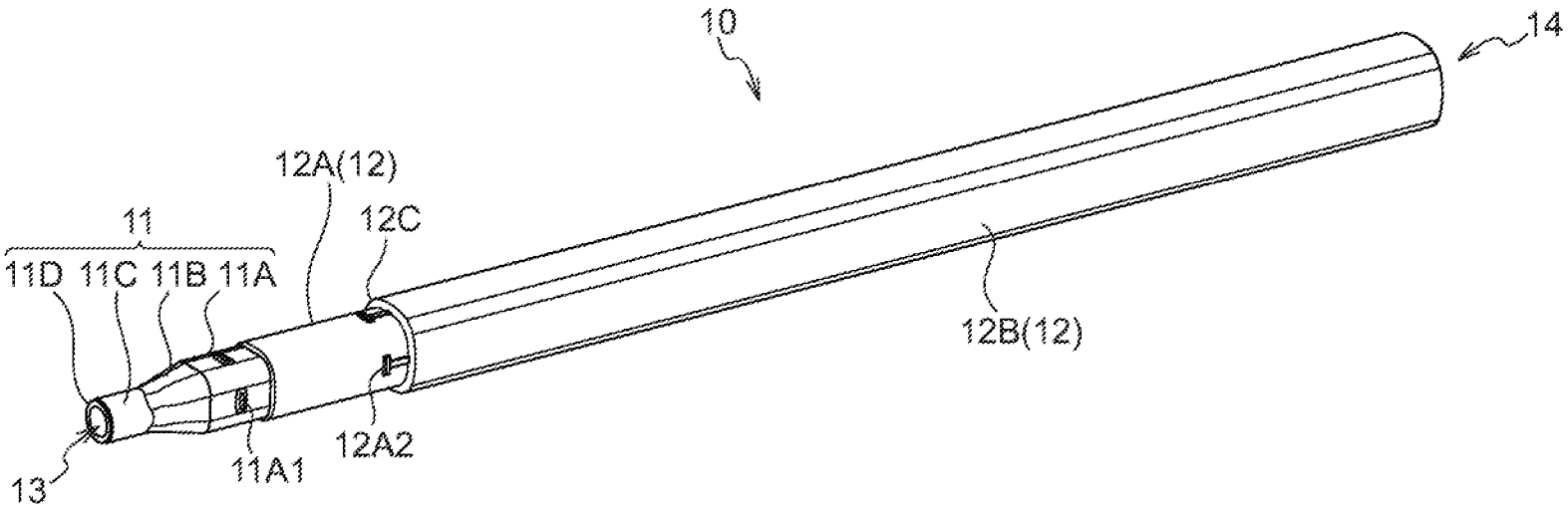
FIG. 14A is a perspective view illustrating a shaft tube of a writing implement according to the second exemplary embodiment.

As illustrated in FIG. 14A (or FIG. 15A), the external profile of the shaft tube 10 is formed in a round-cornered square shape overall in cross-section taken along the lateral direction.

As illustrated in FIG. 12, FIG. 14A, FIG. 14B, and FIG. 14E (or FIG. 15A, FIG. 15B, and FIG. 15E), the rear shaft 12 is integrally formed with a front grip 12A covered by a grip member 40, described later, on the front side, and a rear grip 12B on the rear side.

The front grip 12A and the rear grip 12B include a step where the diameter decreases toward the front at a boundary 12C between the front grip 12A and the rear grip 12B. The thickness of the front grip 12A is accordingly less than the thickness of the rear grip 12B.

Figure 13A:
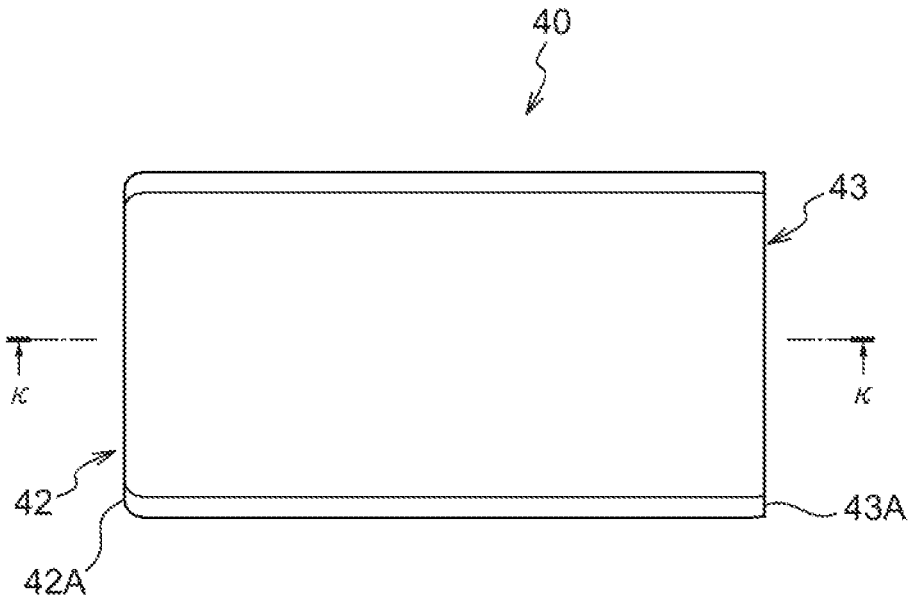
FIG. 13A is a front view of a grip member of a writing implement according to the second exemplary embodiment.
Figure 13B:
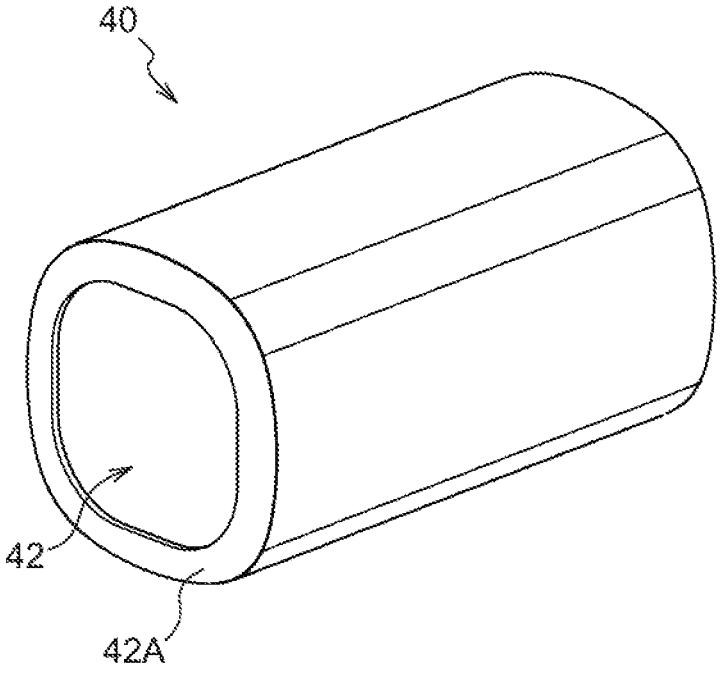
FIG. 13B is a perspective view of the front of the grip member in FIG. 13A.
Figure 13C:
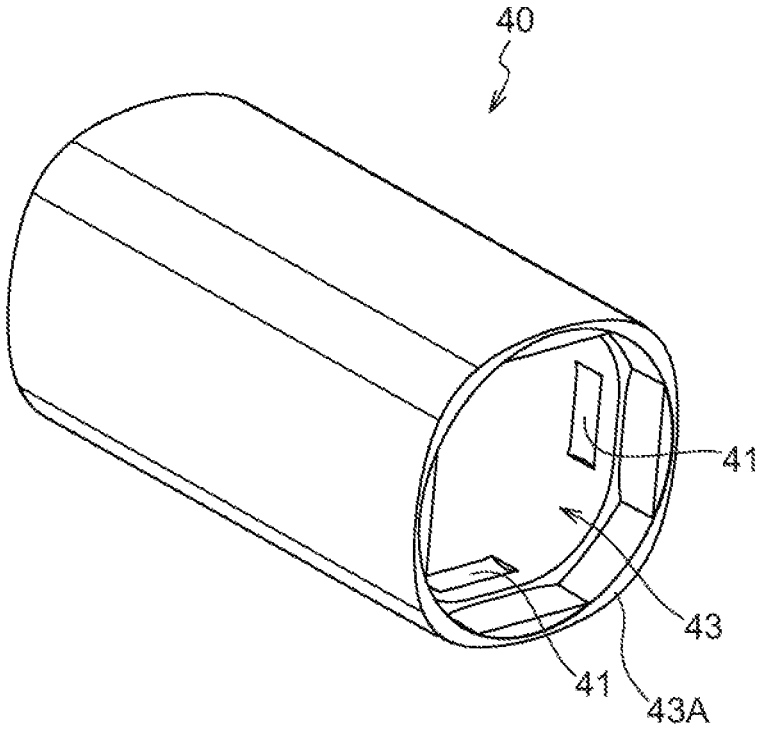
FIG. 13C is a perspective view of the rear of the grip member in FIG. 13A.
Figure 13D:
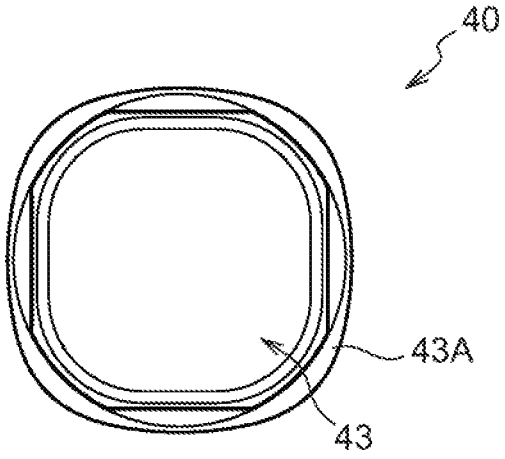
FIG. 13D is a plan view of the grip member in FIG. 13A.
Figure 13E:
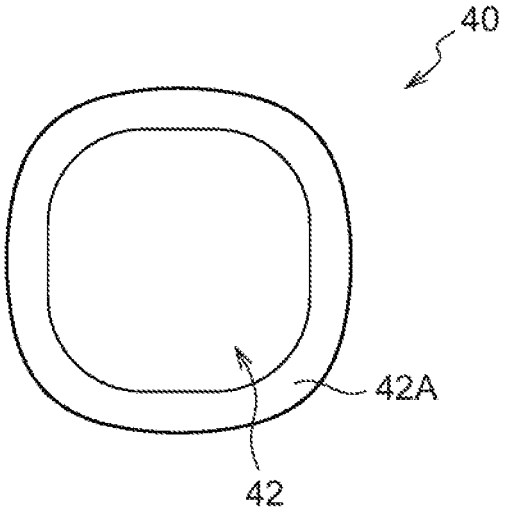
FIG. 13E is a bottom face view of the grip member in FIG. 13A.
Figure 13F:
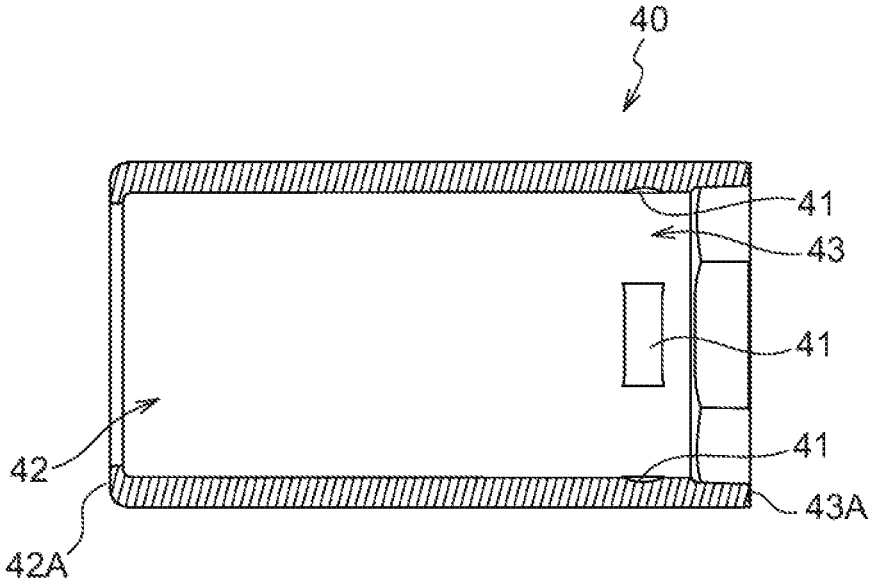
FIG. 13F is a cross-section taken along κ-κ in FIG. 13A.
Figure 14B:
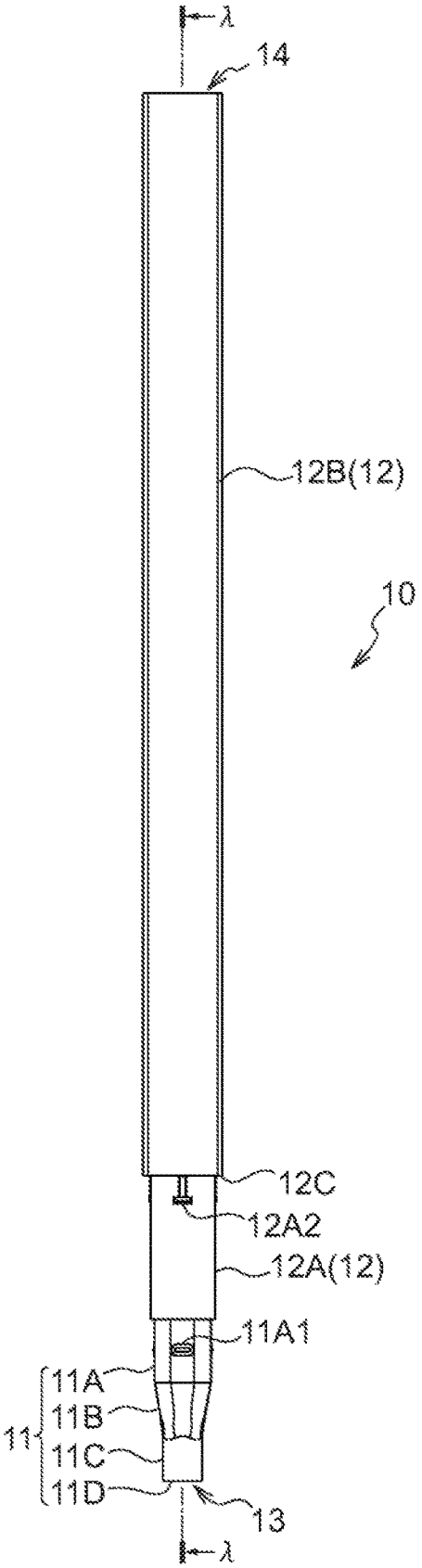
FIG. 14B is a front view of the shaft tube in FIG. 14A.

As illustrated in FIG. 14A and FIG. 14B, an outer protrusion 12A2 employed in engagement with the grip member 40 is formed on each face of the outer periphery of the front grip 12A. The outer protrusions 12A2 fit together with inner recesses 41 (see FIG. 13C and FIG. 13F) formed in inner peripheral faces of the grip member 40, described later.

An end portion 12E at the front of the front grip 12A is formed with a circular arc shaped convex face in cross-section taken along the lateral direction. The tip shaft 11 integrally formed in front of the end portion 12E is narrower than the end portion 12E.

A rear edge of the rear shaft 12 contacts a lip 62 of the tail plug 60 (see FIG. 11C).

As illustrated in FIG. 12, FIG. 14A, FIG. 14B, and FIG. 14E (or FIG. 15A, FIG. 15B, and FIG. 15E), the tip shaft 11 includes, from the rear end, a base portion 11A, a diameter reduction portion 11B, a tip portion 11C, and an anchor face 11D.

The base portion 11A is a portion that extends toward the front with a uniform thickness from the end portion 12E at the front of the front grip 12A. Note that as illustrated in FIG. 14A and FIG. 14B, each side face of an intermediate portion of the base portion 11A is formed with a protrusion running in a direction intersecting the axial direction. These protrusions are referred to as anchor protrusions 11A1. In the present exemplary embodiment, a total of four (see FIG. 14A and FIG. 14B) or a total of two (see FIG. 15A or FIG. 15B) of the anchor protrusions 11A1 are provided, thereby enabling variation in the fitting force arising due to variation in the processed height of the anchor protrusions 11A1 to be suppressed. This enables the cap 50 to be attached and removed easily, even by users with weak hand strength. The anchor protrusions 11A1 may be formed to the cap 50 as well as being formed to the tip shaft 11.

A tip face and a rear end face of each of the anchor protrusions 11A1 are inclined. Of these faces, the tip face has a larger angle of incline. This enables the force required to take off the cap 50 to be reduced while enabling the cap 50 to be attached reliably and imparting a sensation that the cap 50 has been satisfactorily attached or removed.

The diameter reduction portion 11B is a portion extending so as to taper toward the front from a front end of the base portion 11A.

The tip portion 11C is a portion extending toward the front with a uniform thickness from a front end of the diameter reduction portion 11B.

The anchor face 11D is a tip edge of the tip portion 11C, and contacts an engagement tab 33A of an engagement portion 33 of the core surrounding member 30.

Grip Member

As illustrated in FIG. 13A to FIG. 13F, the grip member 40 is formed in a tube shape with a substantially square cross-section overall, and includes a front opening 42 opening at the front, and a rear opening 43 opening at the rear.

The inner recesses 41 are formed as sunken recesses facing toward the inside on each inside face of the grip member 40 in the vicinity of the rear end. The outer protrusions 12A2 provided at the outer periphery of the front grip 12A of the rear shaft 12 fit together with the inner recesses 41 in order to fit the grip member 40 onto the rear shaft 12.

An end portion of the front opening 42 is formed with an edge 42A. An inner face of the edge 42A is formed with a concave circular arc shaped cross-section corresponding to the convex circular arc shaped cross-section of the end portion 12E of the front grip 12A. The front opening 42 is formed with a size allowing the base portion 11A of the tip shaft 11 to be fitted therein.

An end portion of the rear opening 43 is formed with an end face 43A that contacts a step face at the boundary 12C of the rear grip 12B of the rear shaft 12.

The grip member 40 may be applied with a different color to the shaft tube 10. This color may, for example, be a color related to the color of the ink stored in the inner felt 15.

The shaft tube 10 and the grip member 40 may, for example, be formed by two-color molding.

Cap

The structure of the cap 50 is substantially the same as that of the first exemplary embodiment (see FIG. 4A to FIG. 4C and FIG. 5A and FIG. 5B).

Tail Plug

Figure 16A:
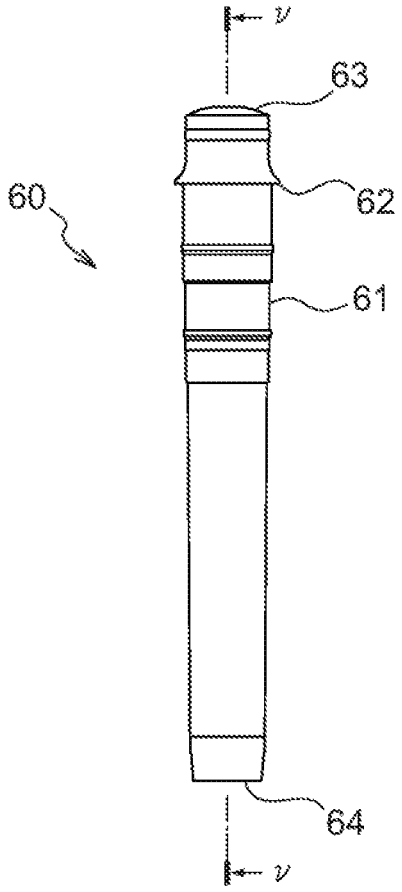
FIG. 16A is a front view of a tail plug of a writing implement according to the second exemplary embodiment.
Figure 16B:
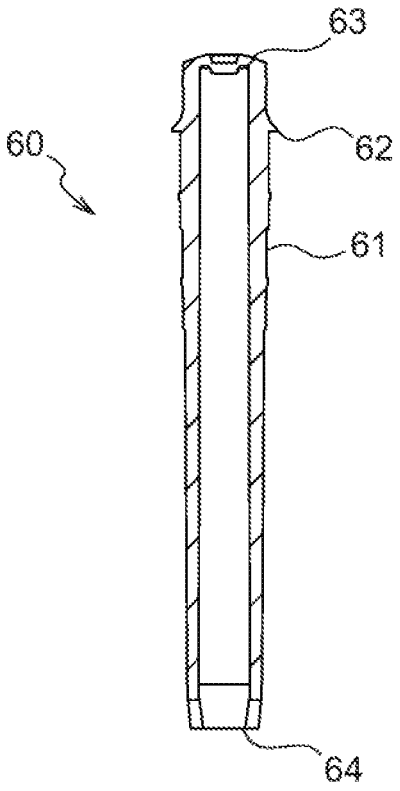
FIG. 16B is a cross-section taken along ν-ν in FIG. 16A.

As illustrated in FIG. 16A and FIG. 16B, the tail plug 60 is formed in a tube shape overall, and includes an insertion portion 61, the lip 62, and a head 63. A tip of the insertion portion 61 configures a tail portion 64.

The insertion portion 61 is inserted into the interior of the rear shaft 12 through the rear opening 14 of the rear shaft 12 of the shaft tube 10 so as to block the rear opening 14 (see FIG. 11C).

The lip 62 tightly closes off the interior of the rear shaft 12 by making close contact with an end face of the rear opening 14, thereby isolating the interior of the rear shaft 12 from external air.

The head 63 is formed extending from the lip 62 toward the rear, and the cap 50 can be fitted on the head 63 during writing.

In lateral direction cross-section, the tail plug 60 is formed with a circular profile at the insertion portion 61, the lip 62, and the head 63. A gently curving concave face connects the outer peripheries of the head 63 and the lip 62. A boundary between the head 63 and the lip 62 is thus not noticeable so as not to be detrimental to the external appearance.

Inner Felt

The inner felt 15 illustrated in FIG. 11C is configured by a circular tube shaped polyester fiber material to store ink, and is housed at the interior of the rear shaft 12 of the shaft tube 10.

Figure 12:
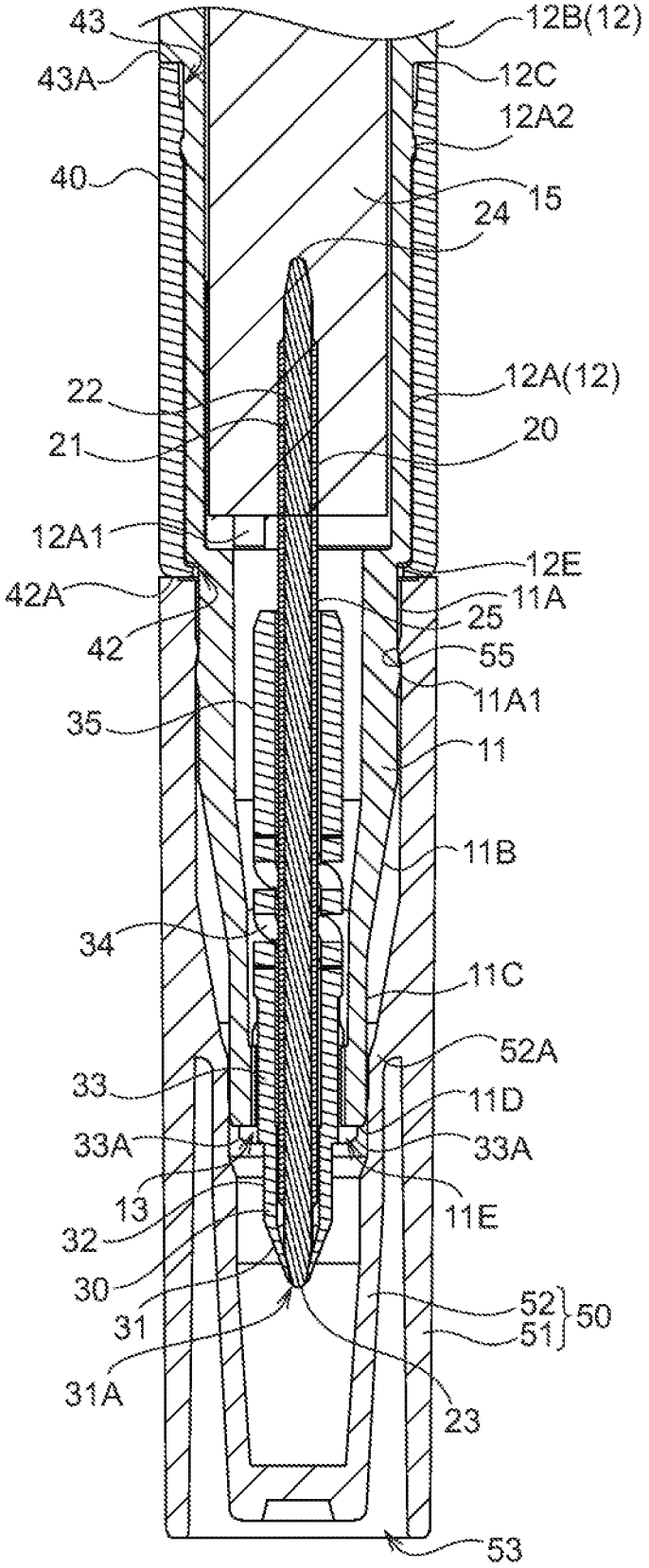
FIG. 12 is an enlarged view of relevant portions in FIG. 11C.
Figure 14C:
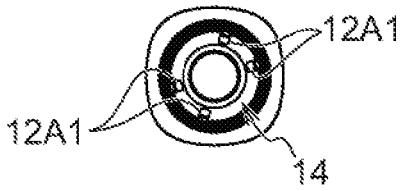
FIG. 14C is a plan view of the shaft tube in FIG. 14A.
Figure 14D:
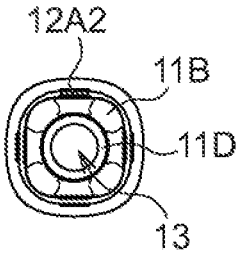
FIG. 14D is a bottom face view of the shaft tube in FIG. 14A.
Figure 14E:
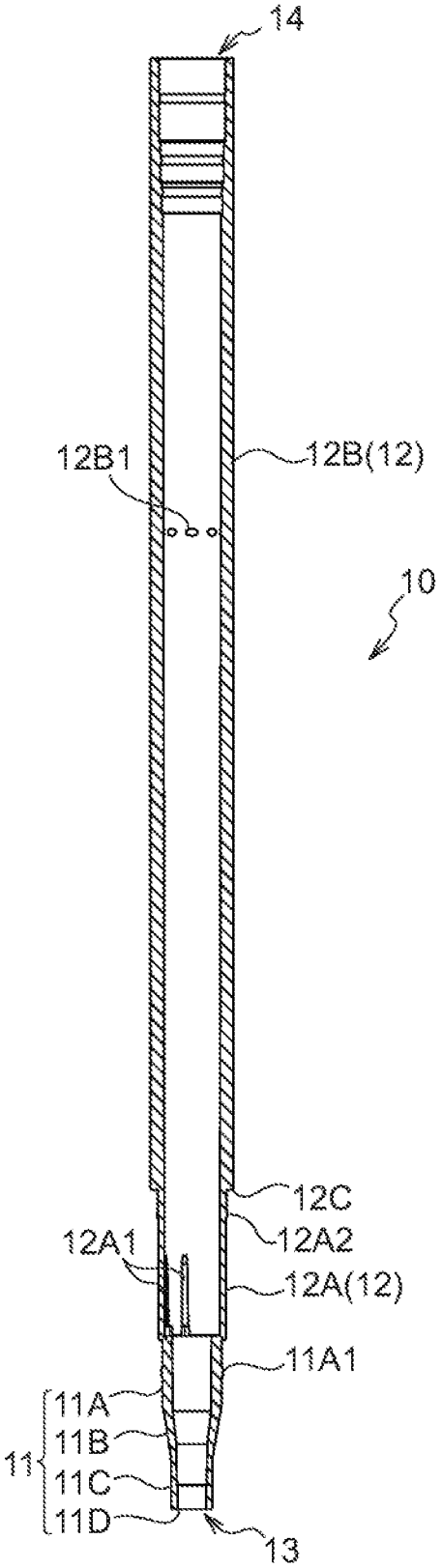
FIG. 14E is a cross-section taken along λ-λ in FIG. 14B.
Figure 15A:
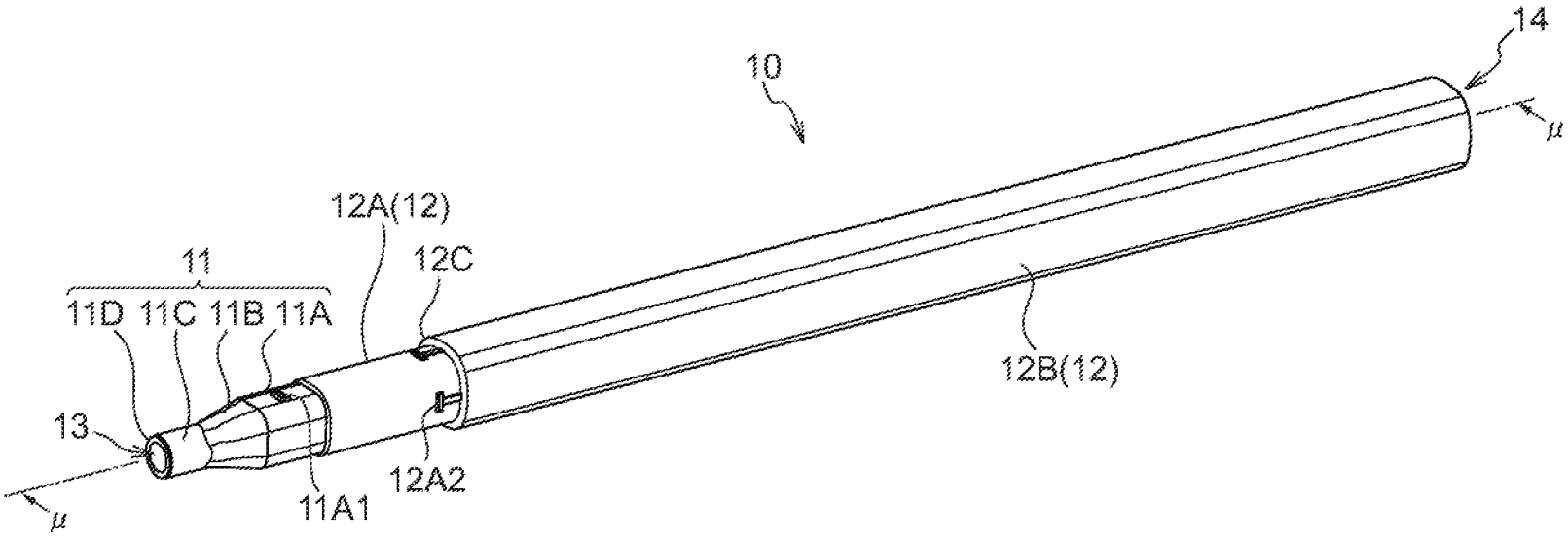
FIG. 15A is a perspective view illustrating a modified example of the shaft tube in FIG. 14A.
Figure 15B:
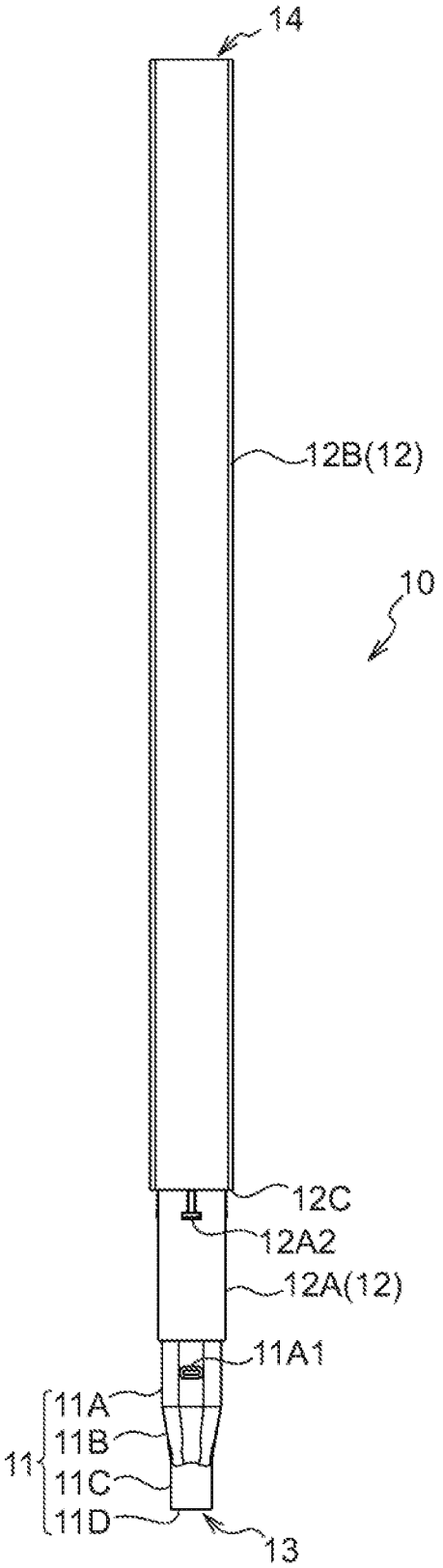
FIG. 15B is a front view of the shaft tube in FIG. 15A.
Figure 15C:
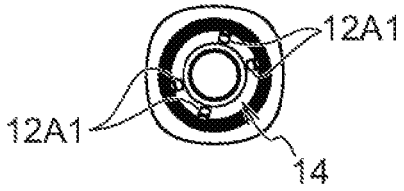
FIG. 15C is a plan view of the shaft tube in FIG. 15A.
Figure 15D:
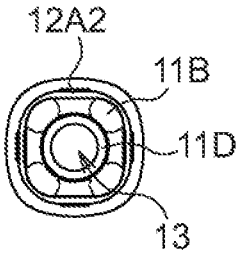
FIG. 15D is a bottom face view of the shaft tube in FIG. 15A.
Figure 15E:
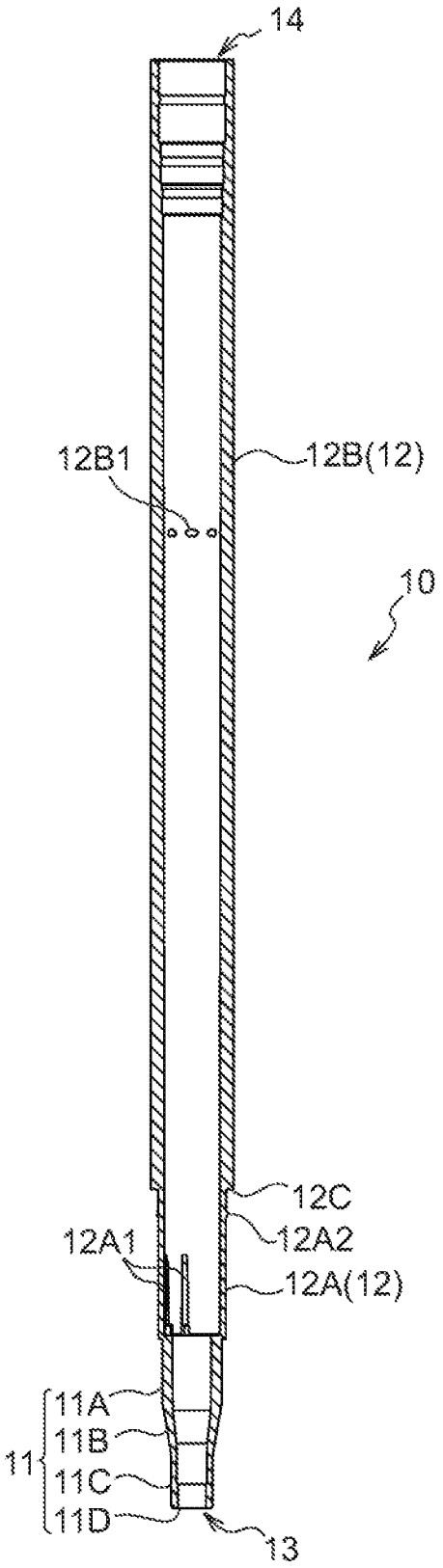
FIG. 15E is a cross-section taken along μ-μ in FIG. 15A.

As illustrated in FIG. 12, a front end portion of the inner felt 15 contacts plural ribs 12A1 (see FIG. 14C and FIG. 14E (or FIG. 15C and FIG. 15E)) formed along the axial direction at an inner peripheral face of the front grip 12A at the interior of the front grip 12A of the rear shaft 12.

A rear end portion of the inner felt 15 is positioned directly in front of the tail portion 64 of the tail plug 60 that fits into the rear shaft 12.

As illustrated in FIG. 11C, the inner felt 15 is thereby positioned between the ribs 12A1 of the front grip 12A (see FIG. 14E (or FIG. 15E)) and the tail portion 64 of the tail plug 60. Note that plural fixing protrusions 12B1 (see FIG. 14E (or FIG. 15E)) are arrayed in a ring shape at an inside face of the rear grip 12B, thereby fixing the inner felt 15 at the interior of the rear shaft 12.

Configuration of Relevant Portions

Explanation follows regarding the ink supply core 20 and the core surrounding member 30, these being relevant portions of the present exemplary embodiment.

Ink Supply Core

As illustrated in FIG. 12, the ink supply core 20 includes an outer peripheral portion 21, a flow path 22, a tip portion 23, a rear end portion 24, and a body 25.

The ink supply core 20 is formed by extrusion molding a polyacetal resin, and has a substantially circular tube shaped profile overall from the front side to the rear side. The tip portion 23 has a circular conical profile that decreases in diameter toward the front, and the rear end portion 24 has a circular conical profile that decreases in diameter toward the rear. The body 25 is interposed between the tip portion 23 and the rear end portion 24, and is configured with a circular tube shaped profile having the same external diameter as the external diameter of the locations of the tip portion 23 and the rear end portion 24 from where the diameter reduction begins. The ink supply core 20 may be configured by a bundled fiber core, a sintered core, or the like.

Outer Peripheral Portion

The outer peripheral portion 21 configures an outer face of the ink supply core 20. A tip of the tip portion 23 and a tip of the rear end portion 24 of the outer peripheral portion 21 are formed such that the flow path 22, described below, is exposed.

Flow Path

The flow path 22 is formed along the axial center of the interior of the outer peripheral portion 21. As described previously, the flow path 22 is exposed at the tip portion 23 and the rear end portion 24 of the outer peripheral portion 21.

During extrusion molding of the ink supply core 20, a die provided with a narrow gap at a central portion is employed to form the flow path 22 as a narrow gap at a cross-section central portion of the ink supply core 20. The flow path 22 configured by the gap exhibits capillary action and retains ink. In this case, the outer peripheral portion 21 and the flow path 22 are integrally formed in the ink supply core 20.

Figure 10C:
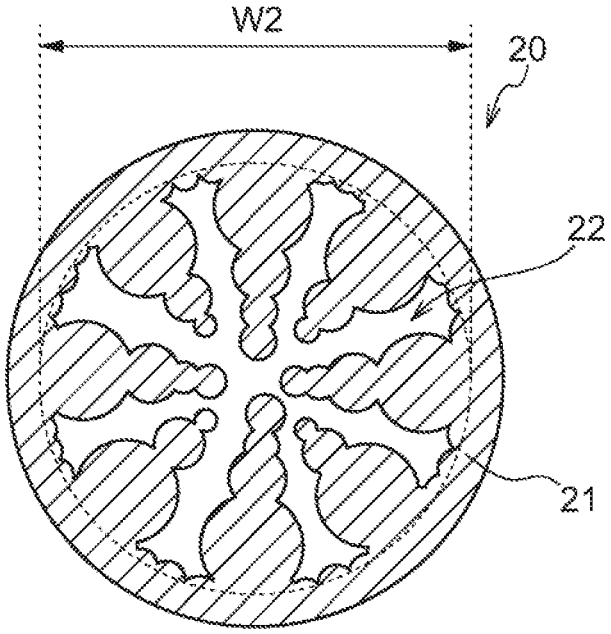
FIG. 10C is a cross-section similar to that of FIG. 10B illustrating another example of the ink supply core in FIG. 10A.

The flow path 22 is similar to that of the first exemplary embodiment (see FIG. 10A to FIG. 10C).

Note that in cases in which the flow path 22 is formed by a bundled fiber core or a sintered core having a capillary structure, the outer peripheral portion 21 can be configured with a structure formed by coating the outer face of the flow path 22, such that the outer peripheral portion 21 configures a thickened portion of the ink supply core 20 at the outside of the flow path 22, thereby enabling the outer face of the flow path 22 to be fixed to the core surrounding member 30 without being exposed.

In the ink supply core 20, ink stored in the inner felt 15 is guided to the tip portion 23 by capillary action through the rear end portion 24 that is inserted into the inner felt 15.

Core Surrounding Member

The core surrounding member 30 is similar to that of the first exemplary embodiment (see FIG. 7A to FIG. 7C and FIG. 8A and FIG. 8B).

Operation of Relevant Portions

Operation of relevant portions is similar to that of the first exemplary embodiment.

Figure 17A:
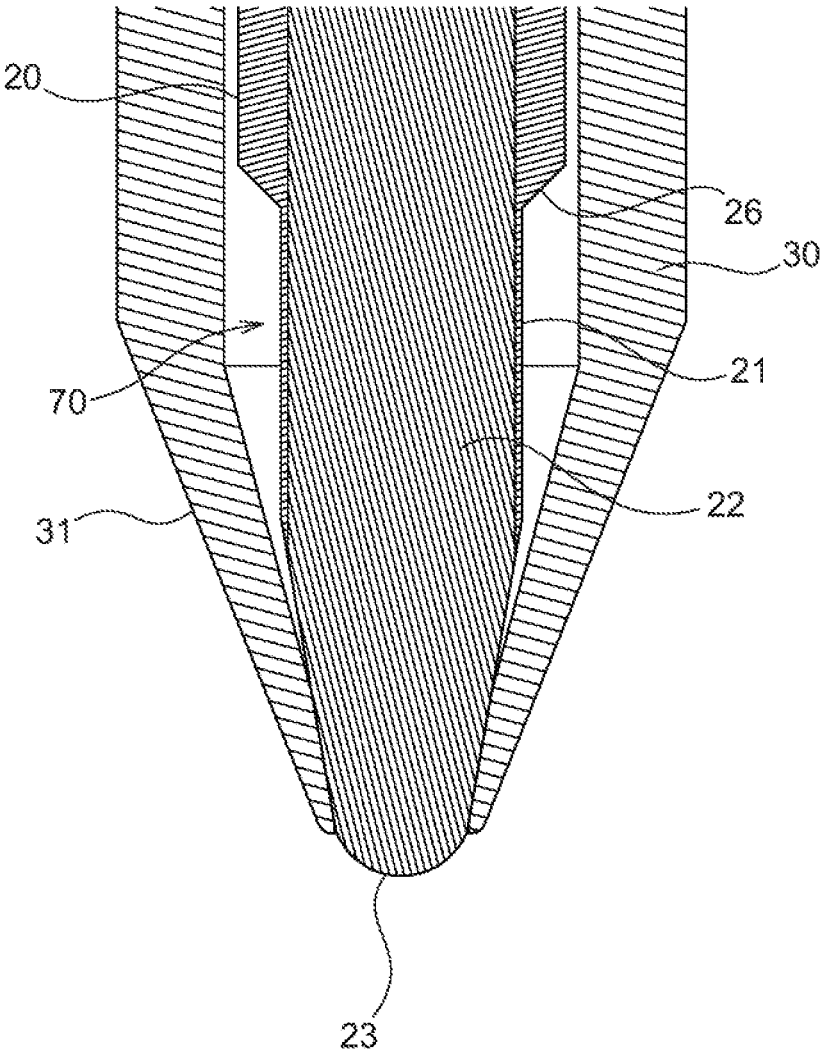
FIG. 17A is a further enlarged view of a tip portion in FIG. 12.

Note that in the present exemplary embodiment, as illustrated in FIG. 17A, a step 26 that locally reduces the external diameter is provided around the entire periphery of a tip portion of the ink supply core 20. The gap between the ink supply core 20 and the core surrounding member 30 is thus provided with an expanded location 70 expanded around the entire periphery. The distance between the ink supply core 20 and the core surrounding member 30 at the expanded location 70 is set to a length at which capillary action does not act on the ink used in the writing implement 1.

Ink that has been guided by the flow path 22 in the ink supply core 20 is dispensed from the tip portion 23 that is not covered by the outer peripheral portion 21, and would normally be transferred to a writing surface as a drawn line. However, some of the dispensed ink penetrates the gap between the outer peripheral face of the tip portion 23 of the ink supply core 20 and the inner peripheral face of the diameter reduction portion 31 of the core surrounding member 30 by capillary action and rises toward the rear. However, the ink that rises up loses its capillary action upon reaching the expanded location 70, and does not rise any further toward the rear. This prevents ink from rising up as far as the interior of the shaft cylinder 10.

Figure 17B:
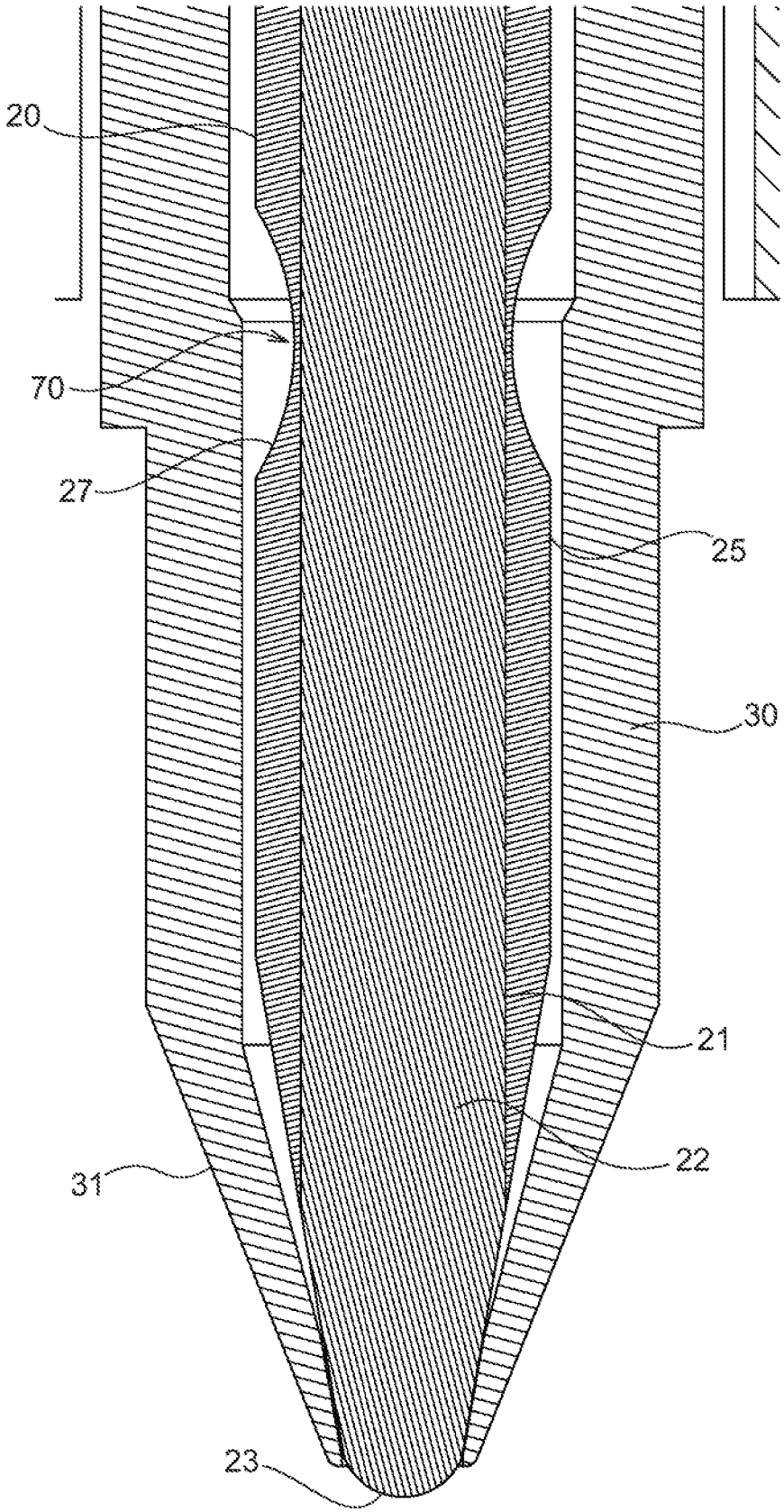
FIG. 17B illustrates a modified example of FIG. 17A.

As in a modified example illustrated in FIG. 17B, a ring-shaped groove 27 may be provided around the entire periphery of the ink supply core 20 at a position toward the tip of the body 25 in order to configure the expanded location 70 at the gap between the ink supply core 20 and the core surrounding member 30 at the position of the ring-shaped groove 27. In this modified example also, the expanded location 70 prevents ink from rising up.

Drawn Line Width

The widths of lines drawn using the writing implement 1 according to Example 4 (W1=0.95 mm, W2=0.55 mm) were measured using three samples numbered No. 1 to No. 3 at a writing speed of 4.5 m/min, a writing load of 0.98 N (100 g weight), and writing angles of 600 and 90°, drawing a spiraling pattern on high quality paper. Results were as in Table 2 below.

TABLE 2

| | Drawn line width (mm) | | |
|---|---|---|---|
| Sample No. | W60 Writing angle 60° | W90 Writing angle 90° | W60/W90 |
| 1 | 0.364 | 0.386 | 0.94 |
| 2 | 0.389 | 0.379 | 1.03 |
| 3 | 0.399 | 0.390 | 1.02 |
| Average | 0.384 | 0.385 | 1.00 |

As above, in all of the samples, for a given writing load, the value obtained by dividing the width of a line drawn at a writing angle of 60° to the writing surface by the width of a line drawn at a writing angle of 90° to the writing surface was in the region of 1.00, this being 0.67 or greater but less than 1.5. Accordingly, the change in drawn line width can be kept to within a specific range.

Other

Detailed explanation has been given regarding specific exemplary embodiments of the present invention. However, exemplary embodiments of the present invention are not limited thereto, and it would be clear to a practitioner skilled in the art that various other exemplary embodiments would be possible within the scope of the present invention.

For example, although explanation has been given regarding exemplary embodiments in which the tip portion 30A and the central portion 30B of the core surrounding member 30 are formed integrally to each other, the central portion 30B may be configured as a separate body. For example, the tip portion 30A and the rear end portion 30C may be formed using the same resin material as in the exemplary embodiments, and a metal spring may be interposed therebetween as the central portion 30B.

Although explanation has been given regarding the inner felt 15 as a means for storing ink, an ink tank may be employed.

INDUSTRIAL APPLICABILITY

The present invention may be employed in writing implements capable of changing the width of a drawn line during writing.

The invention claimed is:

1. A writing implement comprising:

a shaft tube;

an ink supply core that is housed inside the shaft tube and that guides ink by capillary action; and a core surrounding member that is fitted to a leading end of the shaft tube, that is penetrated by the ink supply core, and from which a tip of the ink supply core projects, the ink supply core being configured to retract at a tip of the core surrounding member under writing pressure, and a projection dimension of the ink supply core from the tip of the core surrounding member being from 0.05 mm to 0.7 mm when not being used to write, the core surrounding member including a tip portion, a rear end portion, and an elastic portion between the tip portion and the rear end portion, the elastic portion enabling the ink supply core to retract together with the rear end portion, and the elastic portion elongating rearward under writing pressure.

2. The writing implement of claim 1, wherein:

the ink supply core includes a flow path configured to guide ink internally by capillary action;

the core surrounding member includes a tip opening from which the tip of the ink supply core projects; and a value obtained by subtracting an external diameter of the flow path from an internal diameter of the tip opening is 0.5 mm or less.

3. The writing implement of claim 2, wherein the value obtained by subtracting the external diameter of the flow path from the internal diameter of the tip opening is less than zero.

4. The writing implement of claim 1, wherein the elastic portion is integral to the tip portion.

5. The writing implement of claim 1, wherein the elastic portion is a separate body from the tip portion.

6. The writing implement of claim 1, wherein the ink supply core and the core surrounding member are fixed to each other.

7. The writing implement of claim 6, wherein the fixing is performed by impact deformation of an outer peripheral face of the rear end portion of the core surrounding member.

8. The writing implement of claim 1, wherein an expanded location is provided at a tip portion of the ink supply core such that a gap between the ink supply core and the core surrounding member is expanded around an entire periphery of the tip portion.

9. The writing implement of claim 8, wherein the expanded location is provided by providing a step portion that locally reduces an external diameter around the entire periphery of the tip portion of the ink supply core.

10. The writing implement of claim 8, wherein the expanded location is provided by providing a ring-shaped groove around the entire periphery of the tip portion of the ink supply core.

11. The writing implement of claim 8, wherein, for a given writing load, a value obtained by dividing a width of a line drawn at a writing angle of 60° with respect to a writing surface by a width of a line drawn at a writing angle of 90° with respect to the writing surface is 0.67 or greater but less than 1.5.

* * * * *